US005943801A

United States Patent [19]

Wilkinson

[11] Patent Number: 5,943,801

[45] Date of Patent: Aug. 31, 1999

[54] SYSTEM AND METHOD FOR BACKLIGHTING A DISPLAY

[76] Inventor: Kirk Wilkinson, 32 Lake St., Concord, N.H. 03301-3214

[21] Appl. No.: 09/124,450

[22] Filed: Jul. 29, 1998

[51] Int. Cl.[6] ..... G09F 13/04

[52] U.S. Cl. ..... 40/564; 40/716

[58] Field of Search ..... 40/361, 366, 367, 40/564, 577, 714, 716

[56] References Cited

U.S. PATENT DOCUMENTS

| | | | |
|---|---|---|---|
| D. 291,030 | 7/1987 | Butterfield . | |
| D. 295,922 | 5/1988 | Huffman . | |
| D. 380,617 | 7/1997 | Long . | |
| 947,127 | 1/1910 | Roberts | 40/714 |
| 1,320,537 | 11/1919 | Dimond . | |
| 1,846,533 | 2/1932 | Thompson | 40/361 |
| 1,911,962 | 5/1933 | Morrison | 40/361 |
| 1,988,654 | 1/1935 | Haag | 40/361 |
| 2,297,851 | 10/1942 | Wyss . | |
| 2,487,403 | 11/1949 | Wisdom . | |
| 2,588,545 | 3/1952 | Lawrence | 40/564 X |
| 2,677,909 | 5/1954 | Heydenryk | 40/714 |
| 3,742,203 | 6/1973 | Noe | 40/714 |
| 3,782,015 | 1/1974 | Esry . | |
| 4,170,080 | 10/1979 | Bergh . | |
| 4,404,619 | 9/1983 | Ferguson . | |
| 4,418,378 | 11/1983 | Johnson . | |
| 4,432,152 | 2/1984 | Daenen . | |
| 4,495,718 | 1/1985 | Margalit . | |
| 4,587,754 | 5/1986 | Ossner | 40/564 |
| 4,602,448 | 7/1986 | Grove | 40/541 |
| 4,674,211 | 6/1987 | Pratt | 40/564 |
| 4,794,492 | 12/1988 | Vinther . | |
| 4,819,353 | 4/1989 | Glucksman et al. . | |
| 4,831,755 | 5/1989 | Rodriguez | 40/564 X |
| 4,835,661 | 5/1989 | Fogelberg | 40/546 X |
| 4,851,971 | 7/1989 | MacLagan | 40/564 X |
| 4,939,858 | 7/1990 | Dailey . | |
| 4,942,685 | 7/1990 | Lin . | |
| 4,989,122 | 1/1991 | Allekotte et al. . | |
| 5,012,601 | 5/1991 | Garland . | |
| 5,018,291 | 5/1991 | Pasquale . | |
| 5,075,991 | 12/1991 | Wenkman | 40/611 X |
| 5,134,553 | 7/1992 | Hasegawa | 40/564 X |
| 5,230,172 | 7/1993 | Hsu . | |
| 5,247,745 | 9/1993 | Valentino | 40/546 X |
| 5,251,391 | 10/1993 | Lan . | |
| 5,265,357 | 11/1993 | Yu | 40/714 |
| 5,282,117 | 1/1994 | Fritts . | |
| 5,303,488 | 4/1994 | Todd . | |
| 5,313,724 | 5/1994 | Warner . | |
| 5,335,433 | 8/1994 | Borden . | |
| 5,367,802 | 11/1994 | Rosenberg . | |
| 5,371,656 | 12/1994 | Iorfida . | |
| 5,373,428 | 12/1994 | Day | 40/574 X |
| 5,373,654 | 12/1994 | Whalen . | |
| 5,523,930 | 6/1996 | Fritts | 40/564 X |
| 5,657,563 | 8/1997 | Lane | 40/219 |
| 5,658,068 | 8/1997 | Fritts . | |
| 5,676,444 | 10/1997 | Liao | 40/546 X |
| 5,720,123 | 2/1998 | Taylor | 40/454 |
| 5,761,838 | 6/1998 | Chisholm et al. | 40/716 |
| 5,826,973 | 10/1998 | Melzian et al. | 40/564 X |

*Primary Examiner*—Joanne Silbermann
*Attorney, Agent, or Firm*—Kevin Mark Klughart

[57] ABSTRACT

A system and method of backlighting a display is disclosed in which one or more light sources may be used to provide substantially appropriate uniform backlighting of a display medium and simultaneously provide a visually pleasing light source for a decorative display frame. The disclosed system and method provide for one or more light sources, a lightbox for the light sources, a light mask to provide uniform distribution of the illumination provided by the light sources, a display media container to secure and protect the visual media to be backlit, an optional decorative frame, and an offsetting structure to separate the decorative frame and/or lightbox from the display media container.

The disclosed invention increases the visual appeal of photographs and other visual media while providing a compact and safe means for media display that eliminates the non-uniform illumination and heat buildup problems present in the prior art. Additionally, the present invention teaches a variety of methods in which the decorative frame and/or display media may be illuminated using a single light source, thus permitting backlit displays to be utilized in situations heretofore not possible.

2 Claims, 28 Drawing Sheets

PRIOR ART

PRIOR ART 1501
1509
1510
1511
1504
1502
1514
1512
1503
1508
1516
1513
1506

SYSTEM AND METHOD FOR BACKLIGHTING A DISPLAY

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

CROSS REFERENCE TO RELATED APPLICATIONS

Disclosure Document Deposits

Applicant includes by reference and claims recorded date of conception by virtue of USPTO Disclosure Document Deposit Request for "ILLUMINATED PHOTO/GRAPHIC MEDIA DISPLAY DEVICE" having USPTO receipt 414323, mailed Jan. 31, 1997 to the USPTO via registered mail receipt P536-293-9353, and received by the USPTO Feb. 7, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention discloses a system and method for backlighting a display, and specifically discloses a system and method for backlighting a display having a decorative frame. The term 'decorative frame' will within the context of the present invention will be used to describe any form of decorative treatment used as an adjunct to the display media, and should not necessarily be limited to cases where this ornamentation encircles and/or surrounds the display media. The application of the present invention is primarily targeted towards the display of personal photographs and the like in a residential setting, but has a wide variety of other applications and embodiments. Typical embodiments of the present invention either incorporate or are used in conjunction with decorative surround frames of a wide variety of styles and construction.

Backlighted displays have been widely taught in the art for use in commercial settings and are routinely used for promotional purposes in retail settings. The typical backlighted display device projects light from an enclosed light source out through a graphic display media towards the viewer, thereby enhancing the visual effect (especially in low light situations) during evening hours. Even though backlighted displays are routinely employed for commercial purposes, backlighted displays have not achieved widespread utilization for the display of personal momentos and photographs in residential households, despite the obvious market depth as demonstrated by the myriad of photo and picture frames that are available for use in this application. The popularity of photo and picture frames suggest a cause for low consumer interest in background display systems for their personal use: customers expect to see a decorative frame surrounding their momentos. A review of the prior art indicates that the need to illuminate the decorative frame so it is visible and part of the visual experience has not been addressed by the existing picture frame art.

DESCRIPTION OF THE PRIOR ART

A review of all illuminated display systems in both U.S. Class 40 (Card, Picture, or Sign Exhibiting—subclasses 40/700, 40/715, & 40/716) and Class 362 (Illumination—subclasses 362/31, 362/97, & 362/260) confirm the observation that the decorative frame has not been successfully incorporated into the total low light level visual experience. This prevailing circumstance is due to the functional intent of a decorative frame as incorporated into all internally illuminated display systems—it is intended to conceal the internal light sources. This circumstance causes the illumination emitted through the display media to create a high contrast boundary at the media edges and the decorative frame, casting the frame into a shadow. This condition is especially pronounced in low light environments.

The present invention can be understood best by starting with a brief discussion of the nearest prior art reference, whose deficiencies will form the basis for the solutions provided by the present invention.

U.S. Pat. No. 4.835.661—Fogelberg

FIG. 1 illustrates the construction of the nearest prior art reference ENHANCED LIGHTING UNIT FOR DISPLAYABLE MATERIALS contained in U.S. Pat. No. 4,835,661 issued to Weymouth Fogelberg and Clement V. Fogelberg on May 30, 1989In the configuration (100) illustrated in FIG. 1, the display media (101) is placed in a display retainer (102) which has retaining rims (103, 104) at each edge. The display retainer (102) is essentially a conventional acrylic photo frame having a horizontal base support member (105). Once the display media (101) is mounted in the display retainer (102), the display retainer (102) is affixed to a light box (106) having a curved back (107) and an integral light source (108).

The Fogelberg device may also be fixed in a unit suitable for wall mounting (110), in which an external transformer (111) supplies power for the internal lightbox light source. Significant in this design (110) is the requirement that the display media (112) is not allowed to consume the entire face of the wall display unit, as a light source cover lip (113) is required to shield the internal light source (114). This restriction means that the Fogelberg device can never be used in situations where it is desirable for the display media to entirely consume the face of the backlit display, nor can the backlit display be constructed as a symmetric (and thus aesthetically pleasing) unit.

However, the major deficiency in the operation of the Fogelberg device is its poor light distribution/uniformity over the back face of the display media. FIG. 2 illustrates the path of light travel and background illumination vectors of the Fogelberg device. The radial arcs (202, 204, 209, 216) emanating around light source (214) are shown to indicate the relative light source illumination intensity at various points within the lightbox (201). The Fogelberg device attempted to equalize the illumination at points (221) and (222) along the display media by curving the back face (220) of the lightbox (201), and thus redistribute light ray vectors from the back face (220) of the lightbox (201) to display media areas (222) farthest from the light source (214).

Unfortunately, this approach is significantly flawed in practice because the light intensity decreases as the reciprocal of the square of the radial distance R from the light source (214). For example, the rays at (204) are only ¼ the intensity of those present at radius (202), which corresponds to the 'hot spot' at the face of the display media (221). By the time these same light rays reach the farthest radius illustrated (216), they are attenuated to 1/16 their value at the most intensely illuminated display media point (221). This reduction in intensity level is further compounded by the fact that the illumination (flux density measured in units of lumens per square foot, or foot-candles) is given by the relation $$E = \frac{I}{r^2}\cos\theta \tag{1}$$

where

E≡illumination flux density

I≡source intensity r≡distance from source

θ =angle between incident radiation and tangent to surface meaning that the illumination flux density is subject to the law of cosines. This means that the cosine of the incident radiation to the tangent of the display media surface will approach unity at the hot spot (221) and decrease to near zero at the far portion of the display media (222). This additional multiplicative cosine further reduces the apparent illumination intensity as seen by the display media. See Raymond B. Yarbrough, "Illumination and the National Electrical Code," ELECTRICAL ENGINEERING REFERENCE MANUAL, 5th Edition (ISBN 0-912045-10-8, 1990).

Thus, to make the Fogelberg device work requires that the distance between the light source and the display media be coordinated with the curvature of the back face (220) in an attempt to make the illumination of the display media (212) uniform. Unfortunately, there is no method of adjusting the light source position to achieve this goal without substantially increasing the overall volume of the lightbox (220). Furthermore, the law of cosines as it relates to the illumination flux density works to prevent uniform illumination across the back face of the display media as taught by the Fogelberg disclosure.

The Fogelberg design also suffers from several other undesirable flaws. First, there is a significant issue of heat buildup within the lightbox with this design. As illustrated in FIG. 1, the Fogelberg design prefers to have an external transformer (111) to supply power to the lighting system within the lightbox. This is for good reason. The addition of any other electrical element within the lightbox in this design increases heat dissipation and this heat can have a deleterious effect on the display media, causing it to age and change color. This is a problem with most of the backlighting designs with the prior art.

Closely associated with this is the fact that the use of external components makes this design undesirable for many applications, including home use. A clean, compact design which is both aesthetic and functional dictates that it be possible to integrate all the lighting electronics within the lightbox fixture and still meet safety and functional system specifications.

Yet another problem with the Fogelberg device as seen in other prior art is that while backlighting of the display media may in some way be affected, the frame (or matte (101)) surrounding the media (if present) will always be cast into a shadow, and receive little or no illumination from the lightbox light source. The Fogelberg patent demonstrates the shadow effect when the decorative frame (only implied by notation in their specification) is not part of the illuminated experience. Unfortunately, as is evident in the wall-mounted variation (110)) the separation of the image from the frame further aggravates the masking phenomenon because the masking (113) of the light source is incorporated into the lightbox enclosure. This combination is then enclosed by the decorative frame thereby increasing the boundary between the illuminated image and decorative frame and increasing the shadow effect, and as seen represents an inefficient utilization of the system display boundaries.

It should be noted here that the curved back face detailed in the Fogelberg patent is not unique to his design. Similar back face designs may be seen in the following references:

1. U.S. Pat. No. 2,487,403 issued Nov. 8, 1949 to Raymond I. Wisdom for PHOTOGRAPHIC PRINT MOUNTING FRAME;
2. U.S. Pat. No. 2,297,851 issued Oct. 6, 1942 to Clement H. Wyss for ILLUMINATED DISPLAY DEVICE;
3. U.S. Pat. No. 1,320,537 issued Nov. 4, 1919 to Clark W. Dimond for PORTABLE ILLUMINATED SKETCHING OR WRITING SERVICE;
4. U.S. Pat. No. 4,989,122 issued Jan. 29, 1991 to Heinz A. Allekotte and Gerd Sturm for LIGHT BOX;
5. U.S. Pat. No. 4,794,492 issued Dec. 27, 1988 to Franz J. Vinther for ILLUMINATED BOARD;
6. U.S. Pat. No. 5,373,428 issued Dec. 13, 1994 to Peter Day for LIGHTBOX FOR DISPLAY PURPOSES.

Numerous other references in U.S. Patents exist detailing straight back face structures or back face structures similar to the Fogelberg teachings.

U.S. Pat. No. 4,942,685—Lin

U.S. Pat. No. 4,942,685 issued Jul. 24, 1990 to Ling-Yung Lin, for a picture frame with hidden light illumination loop made of light transmitting material and powered by an AC or DC power supply. The generated illumination is cast all around the frame and the photo located within the frame.

This configuration has the same defect as the Fogelberg device in situations where it is desirable to have some illumination on the decorative frame. The Lin device purposely illuminates the display media to the exclusion of the decorative frame, a result which undesirable for many aesthetic reasons.

U.S. Pat. No. 4,819.353—Glucksman. et. al.

U.S. Pat. No. 4,819,353 issued Apr. 11, 1989 to Dov Z. Glucksman, Paul K. Cohen, and Jorg Ratzlaff details an illuminated picture frame in the shape of an open box provided with two rows of spaced incandescent bulbs arranged on opposite sides of the picture attached to the rear wall of the box.

While this design permits light to be cast on the display media, it is clear that this configuration demonstrates the function of a frame (and in this case including an additional decorative mat for an illuminated picture display apparatus) is to 'mask' and otherwise conceal the light sources causing the referenced visibility problem. As such, the aesthetic appeal of the illumination provided by this illuminated picture frame is indistinguishable from the teachings of the Lin.

U.S. Pat. No. 4,831.755 —Rodriguez

U.S. Pat. No. 4,831,755 issued May 23, 1989 to Jose Rodriguez details a back illuminated frame for displaying translucent plates, the system having a frame assembly with four side walls and a top wall of suitable dimensions to display the plate.

As detailed in this patent, the Rodriguez device requires a multiple number of lamp illumination devices to function properly and provide uniform illumination. This requirement is incompatible with many common media display goals, including low cost and suitability for use in a residential environment.

Patents similar in function to the Rodriguez device, such as those described in U.S. Pat. No. 5,247,745 issued Sep. 28, 1993 to Theresa Valentino for ILLUMINATED PICTURE FRAME APPARATUS are too numerous to detail in this document, but operate on principles identical to or very similar to those in the Rodriguez disclosure.

U.S. Pat. No. 5,251,391—Lan

U.S. Pat. No. 5,251,391 issued Oct. 12, 1993 to Chen-Hwei Lan details an illuminant photo frame comprising a transparent frame body constituted by elongated lines and cross lines respectively having a back side created with a plurality of 45 degree prisms.

In a typical backlit display media application, this design has the following drawbacks:

1. The design is technically complex, lending itself to high cost which is incompatible with market demands for this type of product.
2. Uniform illumination of the display media can only be achieved by using high cost components.
3. The use of a singular illumination means requires specialized optical distribution components for this design to function properly.
4. Any change in frame appearance requires expensive new plastic injection molds, making it difficult for this product to adapt to varied customer stylistic tastes.
5. The frame is fabricated using an intricate prismatic, making manufacture of this product difficult and expensive.

Inclusion of a decorative frame into the backlighted visual experience completes for the viewer a total appreciation of the displayed media. However, the cost and complexity of the Lan device makes it impractical for implementation in cost-conscious environments such as residential homes.

SUMMARY

From the foregoing discussion, it can be surmised that the prior art has the following characteristics:

1. Uniform backlighting of display media has yet to be achieved using a single light source.
2. Multiple light sources are generally required to achieve a uniform backlight display.
3. The use of multiple light sources within a lightbox or similar container tend to cast any decorative frame surrounding the display media into a shadow.
4. Sometimes trim frames if incorporated in a media display system are used to mask the light sources and thus these trim frames tend to cast any decorative frame surrounding the display media into a shadow.
5. The cost to achieve generally acceptable uniformity in backlighting renders many of the prior art designs uneconomical.
6. Closed lightbox designs tend to generate and contain heat, resulting in a degradation of the display media and a potential safety hazard.
7. Systems that do implement some form of backlighting do so at the expense of permitting easy replacement and/or changing of a decorative frame.
8. Current systems do not incorporate light sources within the media boundaries and therefore increase the overall size of the display.
9. Current backlighting display systems do not permit front-loading of the display media.
10. Current backlighting display systems do not permit replacement of the decorative frame to suit changing tastes of the viewer.
11. The appearance of the lightbox and/or backlighting system in most existing designs is not aesthetically pleasing to the overall display.

OBJECTS OF THE INVENTION

Accordingly, the objects of the present invention are to circumvent the deficiencies in the prior art and effect the following objectives:

1. Eliminate the possibility of visual 'hot spots' generated by embodiments of the prior art by providing a more appropriately uniform illumination background for the display media;
2. Permit the cost of a uniformly backlit display to be drastically reduced by using a design which allows a single light source to provide substantially appropriate uniform illumunation
3. Permit the elimination of one or more light sources in current applications which require a multiple number of light sources to achieve uniform backlit illumination;
4. Permit a single light source to be the illumination vehicle whereby which a decorative frame is illuminated;
5. Permit the decorative frame of a backlighted display system to be incorporated into the visual experience by permitting the backlighting light source to illuminate the decorative frame;
6. Permit the decorative frame to add to the visual quality of a backlit display while maintaining a low overall display system cost;
7. Permit interchangeable and multiple frame styles to be used with a given backlit display system;
8. Permit readily available molding styles to be incorporated and/or substituted into the display visual experience, consistent with changing and varied consumer stylistic tastes;
9. Enhance the visual appearance of the backlit display apart from the display media which it may incorporate;
10. Permit a symmetric backlit display to be constructed which requires only a single light source for illumination;
11. Permit a backlit display to be constructed that does not require volume outside the confines of the display media to house the illumination source;
12. Permit a backlit display to be constructed with minimal volume consistent with the goal of more substantially appropriate uniform backlit illumination;
13. Permit backlighting of typical photo/frame assemblies with no substantial increase in overall display system volume;
14. Permit the backlit display to be sized to fit the confines of residential environments, such that the display system is suitable for placement on a standard bookshelf, mantle, end table, or the like.
15. Permit the backlit display to be easily integrated in artistic environments such as photographic art galleries and the like;
16. Permit front viewer-side service access to the display to permit replacement of the light source;
17. Permit front viewer-side service access to the display to allow the display media to be easily changed;
18. Reduce the heat buildup within the display enclosure by allowing air to circulate in and around the display frame;
19. Protect the display media from excessive degradation due to exposure to excessive heat from the illumination source;
20. Permit the entire illumination source and its support circuitry to be incorporated into the display enclosure, thus eliminating external components such as transformers, ballasts, and the like associated with existing backlit displays;

21. Permit an optional automatic activation of the backlighting light source on detection of the presence of a viewer in the vicinity of the display media;
22. Provide for one or more light sources within the boundary of the display media, and employ simple masking and reflective light leveling means to achieve uniform illumination of the display media and the decorative frame using a lightbox assembly of limited depth dimension;
23. Permit backlighting illumination to be affected for small and medium-sized photos which are too small to be backlit by existing backlighting systems without increasing the overall size of the media display area or the decorative frame;
24. Significantly improve the novelty and utility of the backlighted display for the presentation of personal momentos and the like in a residential setting through implementation of the aforementioned objectives thus creating new customer interest in this display media.

These objectives are achieved by the presently disclosed invention which is discussed in the following sections.

BRIEF SUMMARY OF THE INVENTION

Briefly, the invention is a system and method permitting the backlight illumination of a display for the purposes of enhancing the visual and aesthetic qualities of display media as well as any decorative frame used in conjunction with the display media.

Briefly, recognizing that illumination of the decorative frame is necessary to improve visibility in low light level situations, this invention provides means to distribute reflected ambient image illumination emanating from one or more light sources located within the lightbox onto the decorative frame. To achieve this desired result with a lightbox configuration that promotes interchangeable decorative frames, one or more light sources are located within the lightbox immediately adjacent to the lightbox sidewalls. Light source location is concealed by simple opaque light mask located directly above the elongated light source epicenter, in the direct viewer sightline, thereby simplifying and isolating frame function to interchangeable decorative purposes. To prevent a shadow being cast by the light mask on the back of the display media, the light mask is separated from the side wall creating a compensating aperture which promotes sufficient illumination to pass and be cast onto the backside of the display media thereby illuminating any 'hot spots' or shadows cast onto the display media.

Illumination for the decorative frame is a continuation of the light source illumination created and provided for the display media which has been directed by a myriad of ambient paths onto the decorative frame through an continuous peripheral separation between the display media and the decorative frame. To achieve a uniform illumination for the display media (which has been substantially offset in front of the decorative frame opening to create the peripheral separation), the display media container incorporates a continuous peripheral reflection zone substantially perpendicular to the backside of the display media which reconcentrates the increasingly ambient illumination (due to its removed location from the light source(s)) onto the back of the display media.

Note that a typical 'picture frame' has the displayed media at it's point of insertion—usually at the back of the frame and opposite from the viewer side of the frame. This contrast with the present invention can be seen by comparing a present invention exemplary embodiment illustrated in FIG. 11 (1109) with the conventional prior art frame side view in FIG. 12 (1203). A similar contrast is detailed by the assembly drawing of a present invention exemplary embodiment illustrated in FIG. 13 (1305) as contrasted with the conventional prior art assembly side view in FIG. 14 (1405).

BRIEF DESCRIPTION OF THE DRAWINGS

For a fuller understanding of the advantages provided by the disclosed invention, reference should be made to the following detailed description together with the accompanying drawings wherein.

DESCRIPTION OF THE PRESENTLY PREFERRED EXEMPLARY EMBODIMENTS

Figure 1:
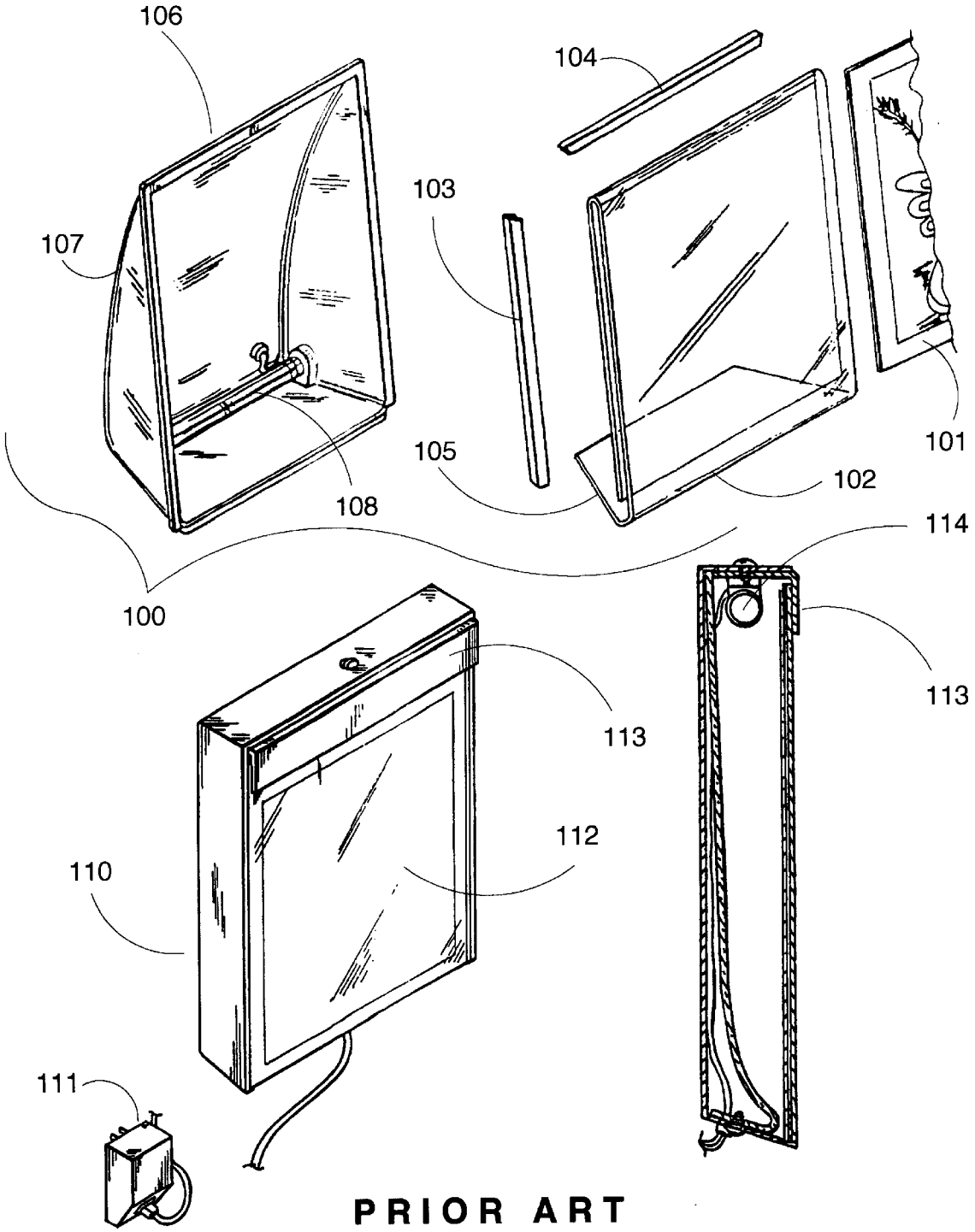
FIG. 1 illustrates the construction of the nearest prior art reference ENHANCED LIGHTING UNIT FOR DISPLAYABLE MATERIALS contained in U.S. Pat. No. 4,835,661 issued to Weymouth Fogelberg and Clement V. Fogelberg on May 30, 1989.
Figure 2:
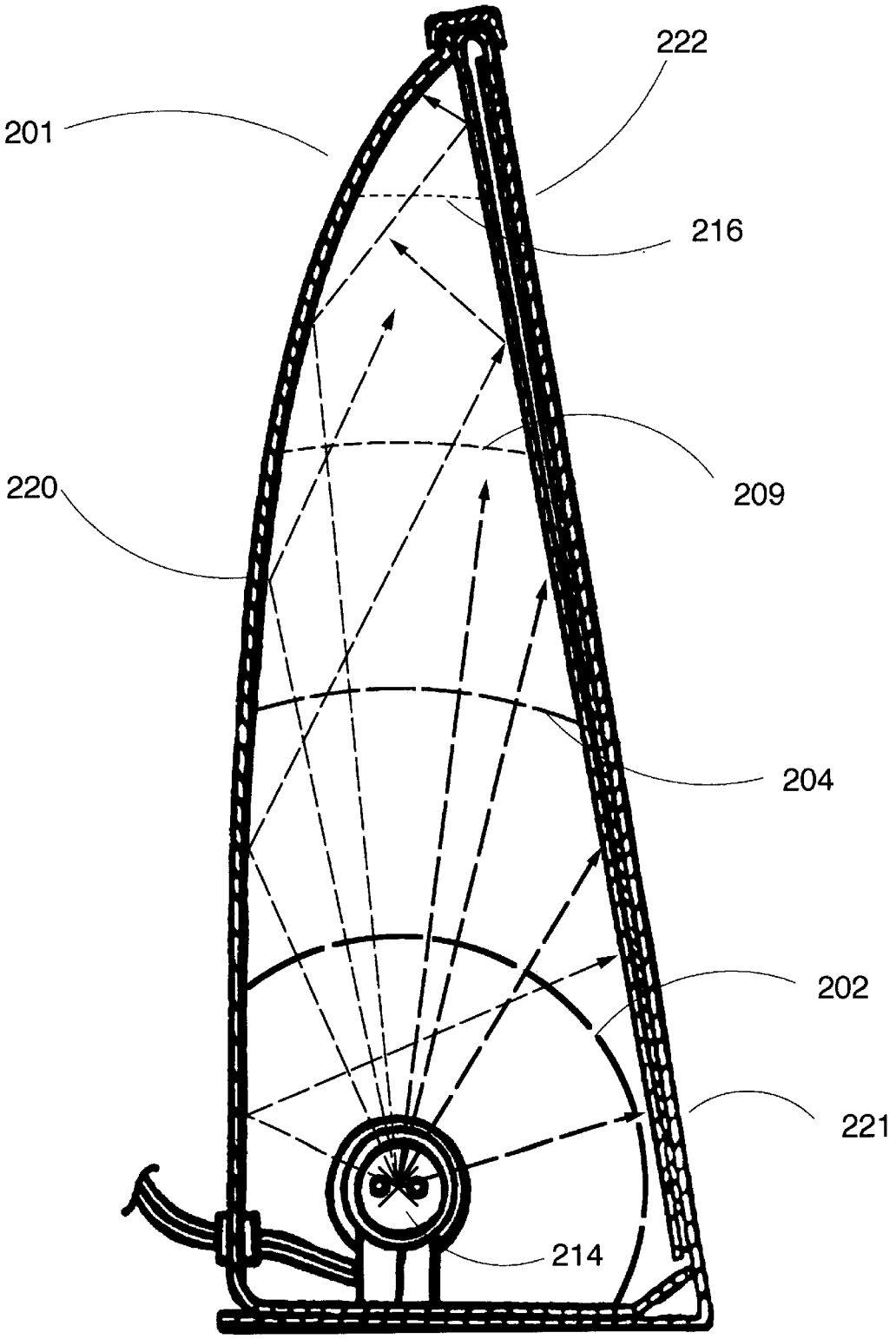
FIG. 2 illustrates the path of light travel and background illumination vectors of the nearest prior art reference ENHANCED LIGHTING UNIT FOR DISPLAYABLE MATERIALS contained in U.S. Pat. No. 4,835,661 issued to Weymouth Fogelberg and Clement V. Fogelberg on May 30, 1989.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

System Overview

Figure 3:
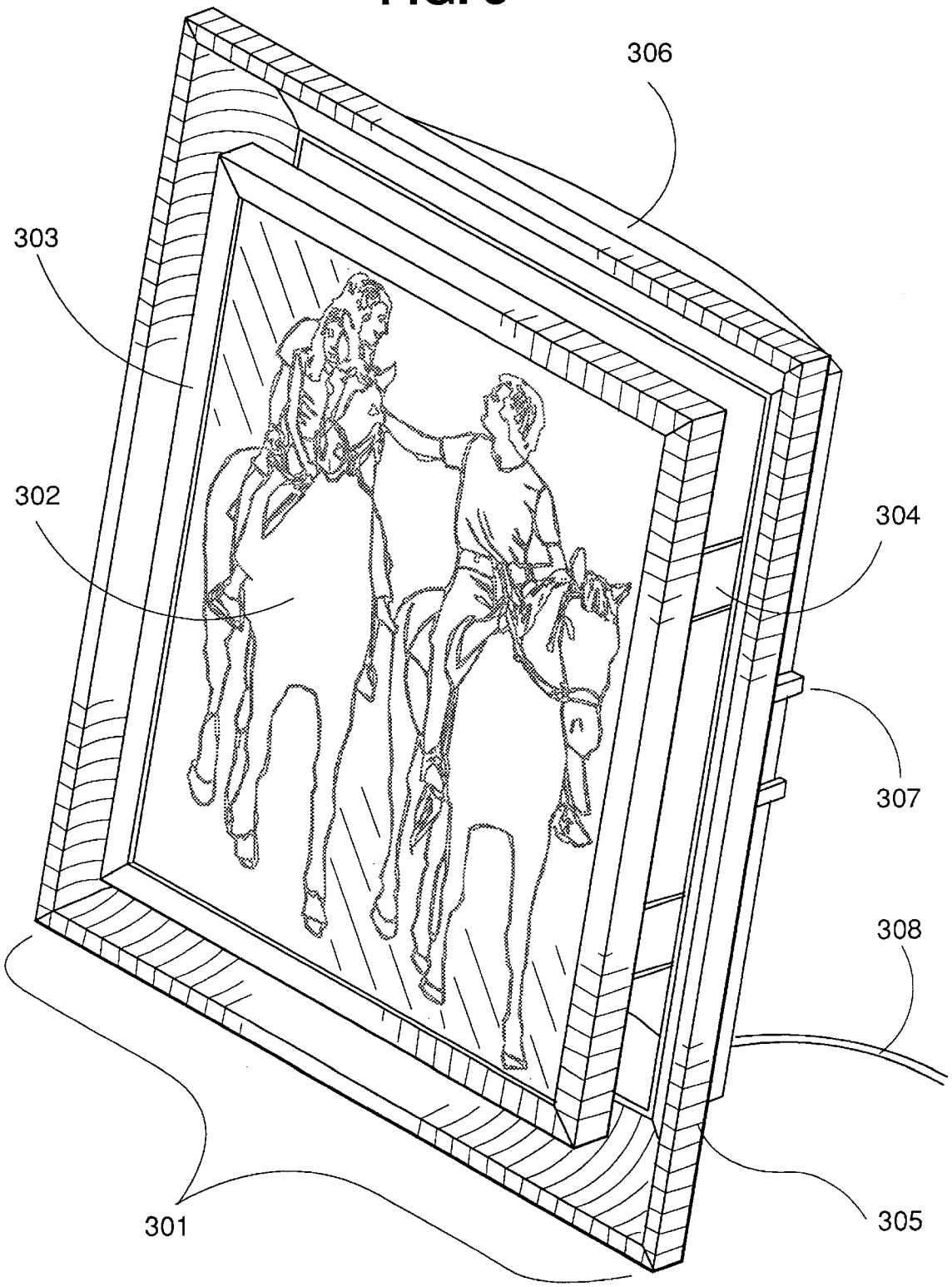
FIG. 3 illustrates a front isometric view of one preferred embodiment of the present invention with display media installed for viewing.
Figure 4:
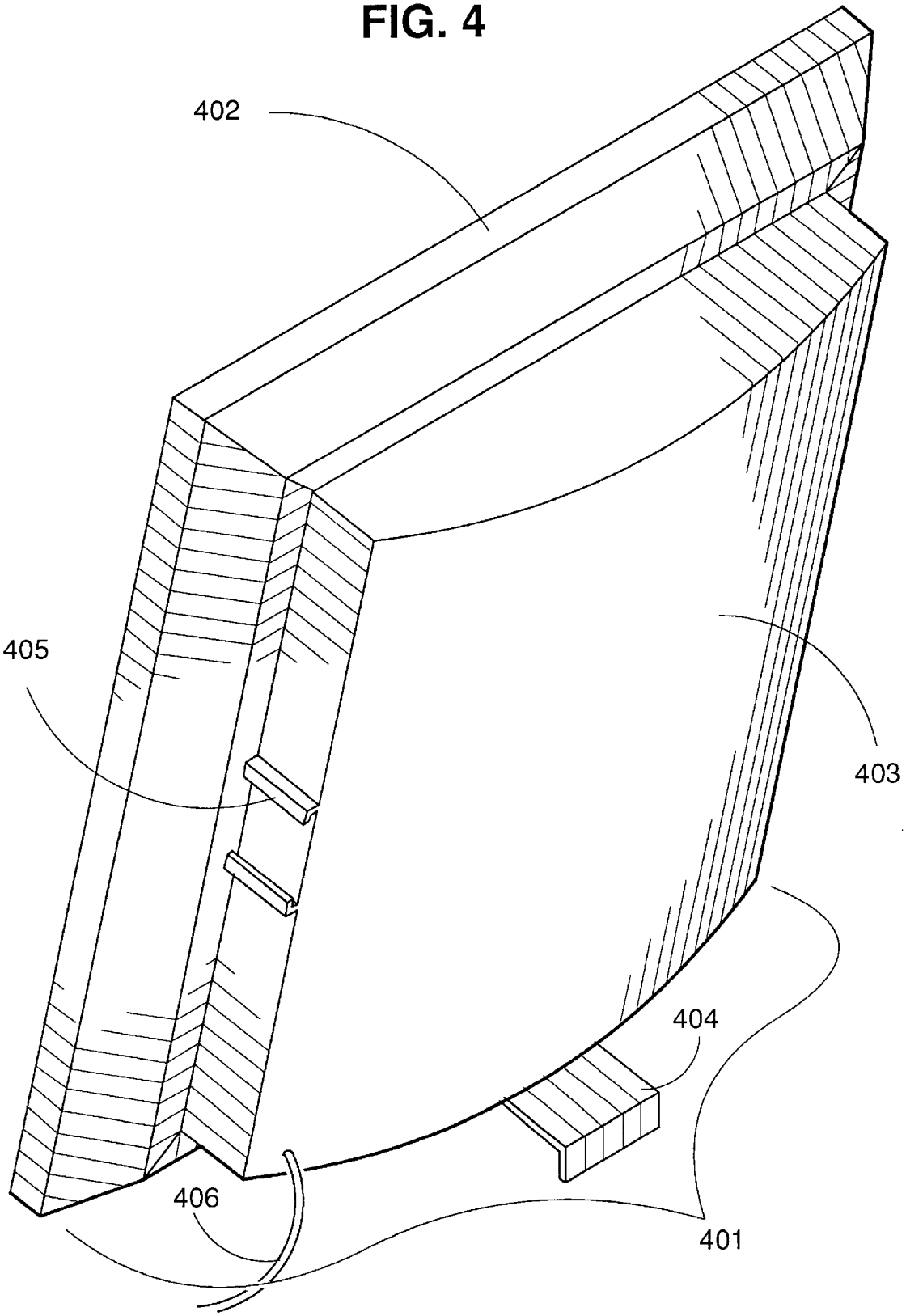
FIG. 4 illustrates a rear isometric view of the preferred embodiment illustrated in FIG. 3.
Figure 26:
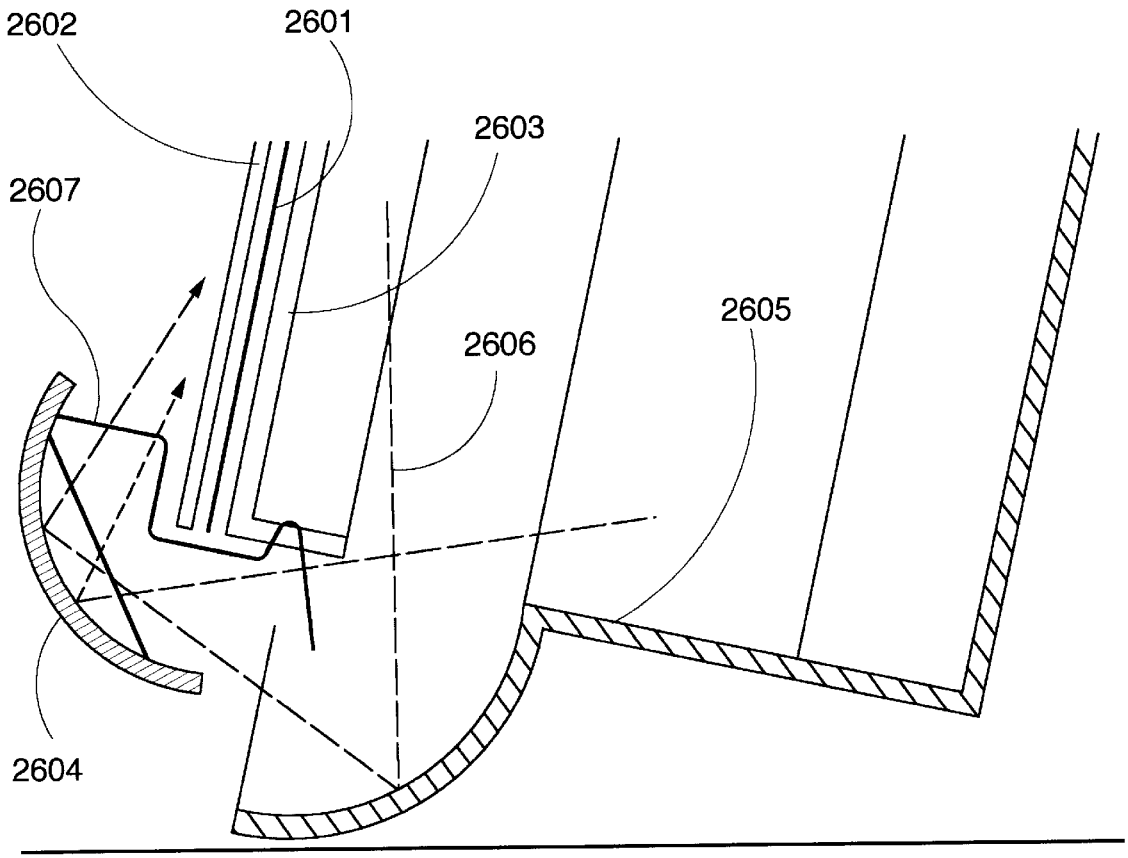
FIG. 26 illustrates a side view of an example of one exemplary embodiment of the present invention in which an external reflective member is used to illuminate the front surface of the display media using a combination of back-scattered lightbox illumination and decorative frame illumination.
Figure 27:
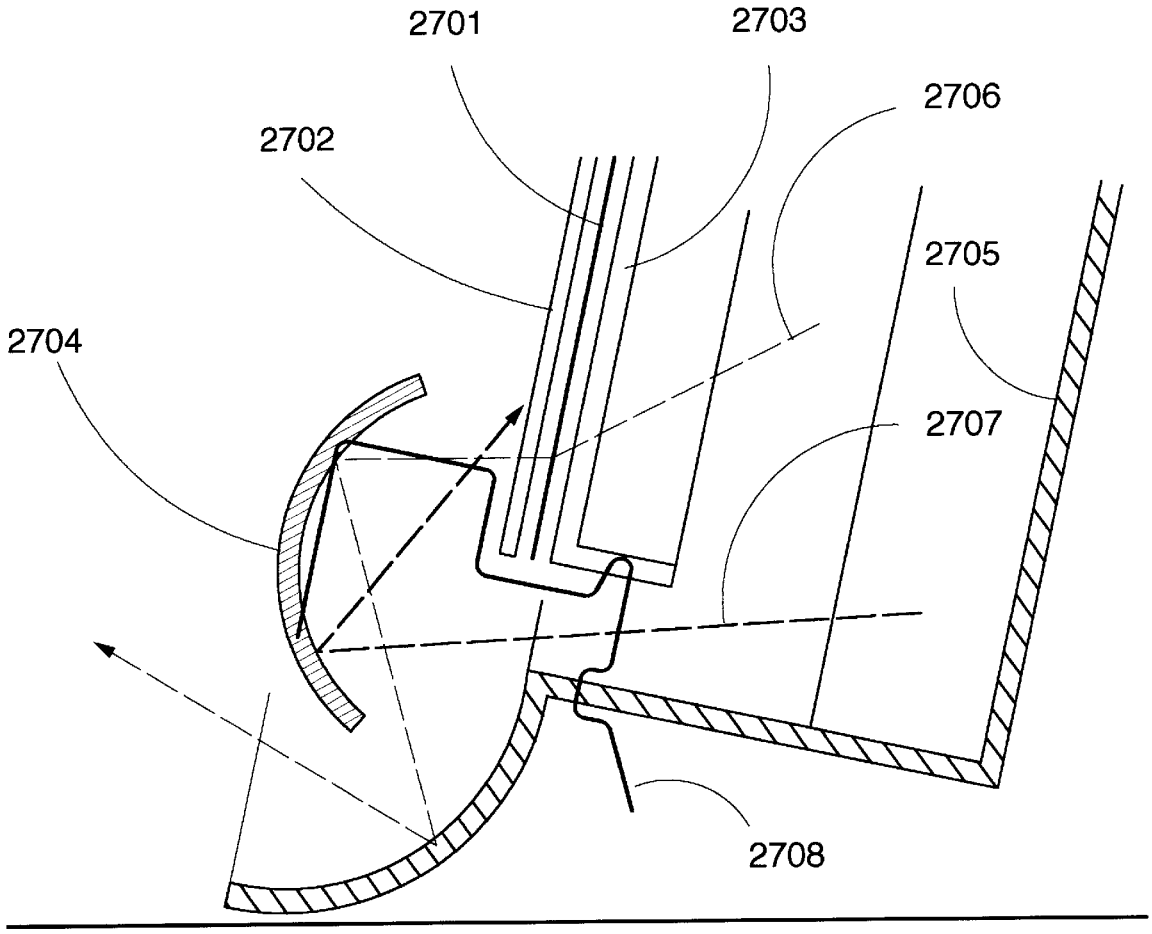
FIG. 27 illustrates a side view of another example of one exemplary embodiment of the present invention in which an external reflective member is used to illuminate the front surface of the display media using backscattered lightbox illumination while simultaneously illuminating a decorative frame.

Referring to FIG. 3, a system overview of a preferred embodiment of the present invention (301) as implemented in a typical application would include the following items:

1. Display Media (302). This is the photograph, momento, or other translucent and/or transparent object that is the subject matter of the backlit display. Although shown for purposes of systems illustration in FIG. 3, the present invention should not be necessarily construed to require a display media as an element of its construction.
2. Display Media Container (303), which may typically comprise a retainer frame which typically retains the edges of the display media, a media platen which backs the display media, and a protective glazing which covers the display media. Note that the display media container may have a wide variety of forms and combinations of retaining frame, media platen, and protective glazing and still conform with the spirit of the invention. No element of this list is absolutely required to implement the present invention.
3. Offsetting Structure (304) which provides a mechanism whereby the display media container (303) may be offset from the decorative frame (305). This functionality may be provided in an innumerable number of ways, and is implemented in the FIG. 3 embodiment via the use of a plethora of plastic tongs (extensible projections or the like) attached to the display media container (303). If constructed of plastic, these tongs permit rapid front disassembly of the display media container and/or lightbox (306). The offsetting structure (304) may be integrated into one or more elements of the display media container (303), and in one preferred embodiment the offsetting structure is integrated with the media platen.
4. Decorative Frame (305) which provides an ornamental and visually pleasing adjunct to the display media. For obvious reasons of taste, the present invention envisions that any type of molding of any material (wood, plastic, acrylic, metal, ceramic, plaster, glass, or organic or inorganic composition, etc.) may be used to form a decorative frame suitable for this application. Note that in some applications the decorative frame may provide a functional method of dispersing light onto the surface of the display media. Several exemplary embodiments of this technique are illustrated in FIG. 26 and FIG. 27. Note that a variety of illumination sources are available for this technique: backscattered lightbox illumination as well as illumination from the decorative frame may be used in this application. Some embodiments of the present invention may dispense with the decorative frame, and as such it is not a required element of the backlighting system. Other embodiments of the invention may integrate the decorative frame with the lightbox (306) as a unitary structure.
5. Lightbox Enclosure (306) which provides backscatter control for the backlighting light source, as well as providing a mounting means for the backlighting light source. As illustrated in FIG. 4, the back of the lightbox enclosure (403) is curved to permit optimal uniformity of light distribution on the back of the display media. The construction of the lightbox display is coordinated with the construction and positioning of the internal light source to provide a uniform illumination across the back face of the display media, as exemplified by the embodiment illustrated in FIG. 20. Notable in the present invention is the potential for incorporation of all the components necessary to support the illumination system within the lightbox. As FIG. 3 and FIG. 4 indicate, the preferred embodiments have only a standard power cord (308, 406) external to the lightbox to support power entry into the lightbox. Thus, no external transformers or ballasts are envisioned for the preferred embodiment, although it is possible to mount these external to the lightbox in some applications.
6. Prop Stand Channel(s) (307; FIG. 4, 405) may optionally be incorporated in some invention embodiments to permit a prop stand (404) as illustrated in FIG. 4 to be attached to the backlighting system. This permits the backlighting system to be oriented for display along either major rectangular axis, thus permitting tabletop exhibition of display media.

Note that nothing in this disclosure should be interpreted to limit the application of the present invention to surface (table top and the like) displays. The present invention may be embodied in a wide variety of configurations for wall mounting and the like.

These major system components will be discussed in detail with reference to the attached drawings.

Detailed Figure Description

FIG. 3 demonstrates a typical table top application of an invention embodiment with sample media and offset picture platen supported by offsetting structures creating peripheral light passage for illumination of a decorative frame.

FIG. 4 illustrates a rear view of one preferred embodiment, clearly illustrating the curved backscattering panel (403) and channels (405) which suggest a prop-stand attachment when the display is positioned along a major rectangular axis.

Figure 5:
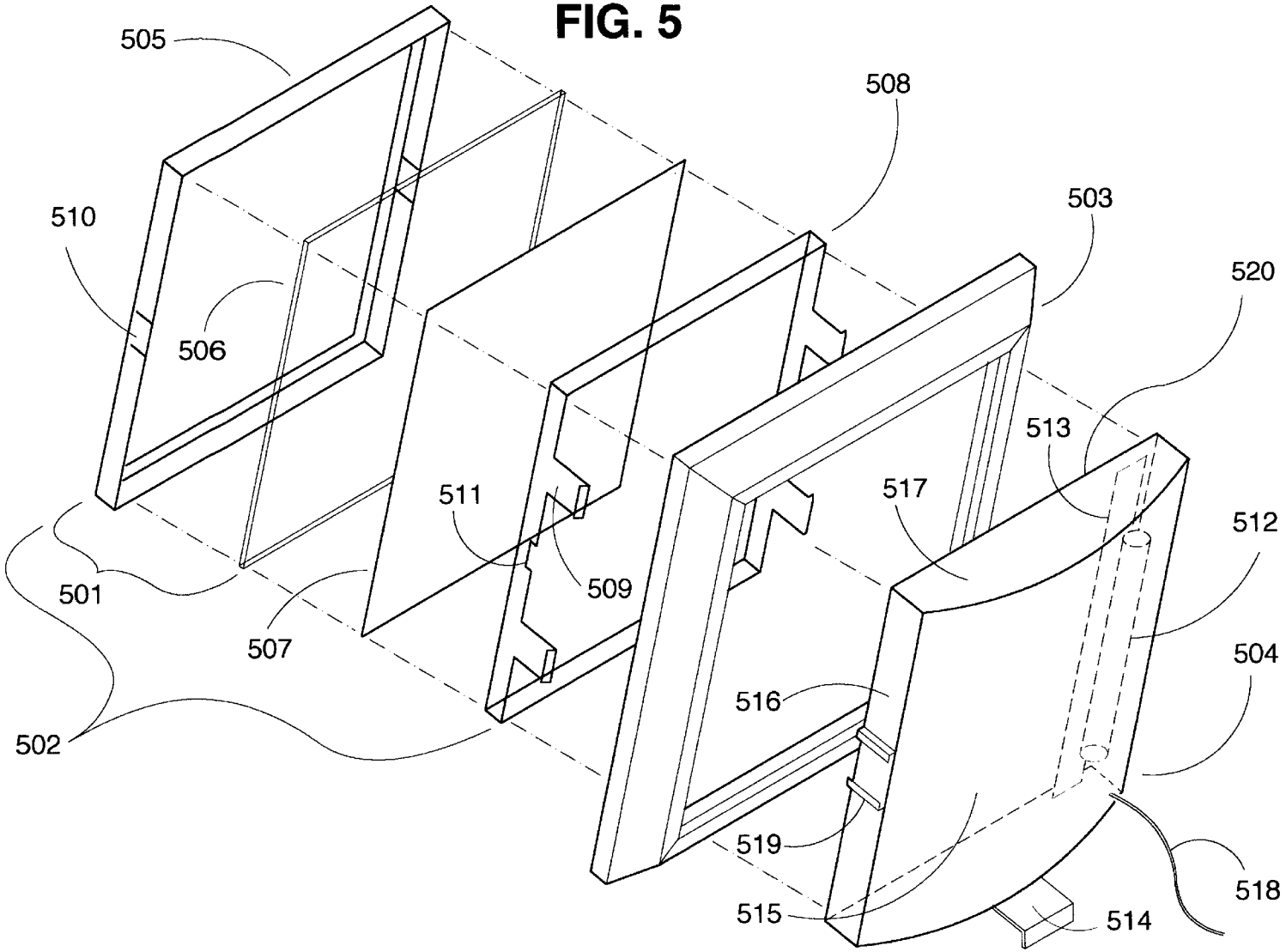
FIG. 5 illustrates an expanded assembly drawing of one preferred embodiment of the present invention.

FIG. 5 illustrates an expanded view of preferred embodiment demonstrating the spatial relationship of six main system components: media retainer frame (505), protective glazing (506), display media (507), media platen (508), decorative frame (503), and lightbox (504).

Figure 6:
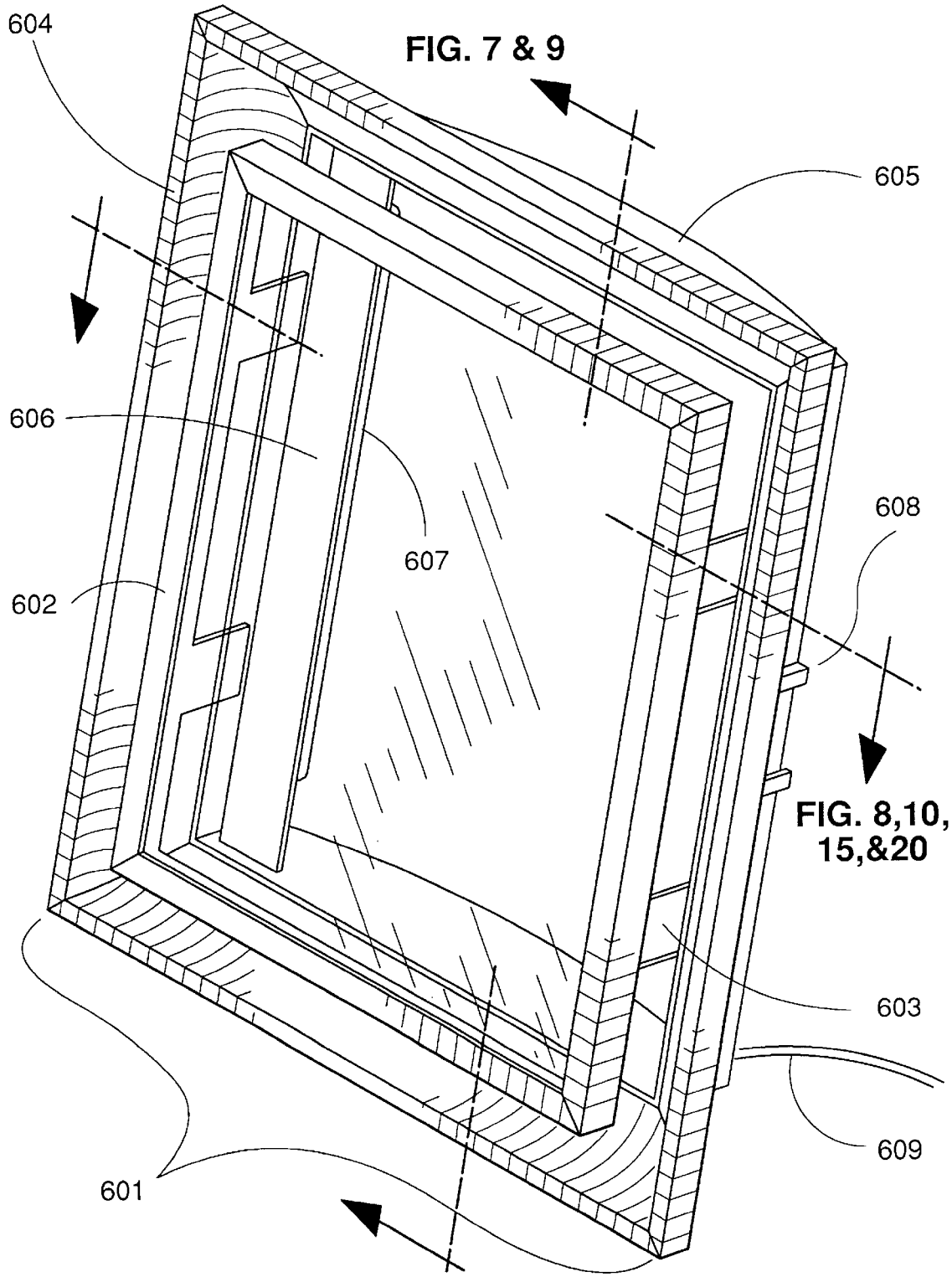
FIG. 6 illustrates a front view of one preferred embodiment of the present invention with display media removed.

FIG. 6 illustrates one preferred embodiment similar to FIG. 3 without the display media showing the entire peripheral light passage created by the display media container (602) as supported by offsetting structures (603) and illuminated by elongated light source (607) and light mask (606) which are shown located adjacent to lightbox sidewall.

Figure 7:
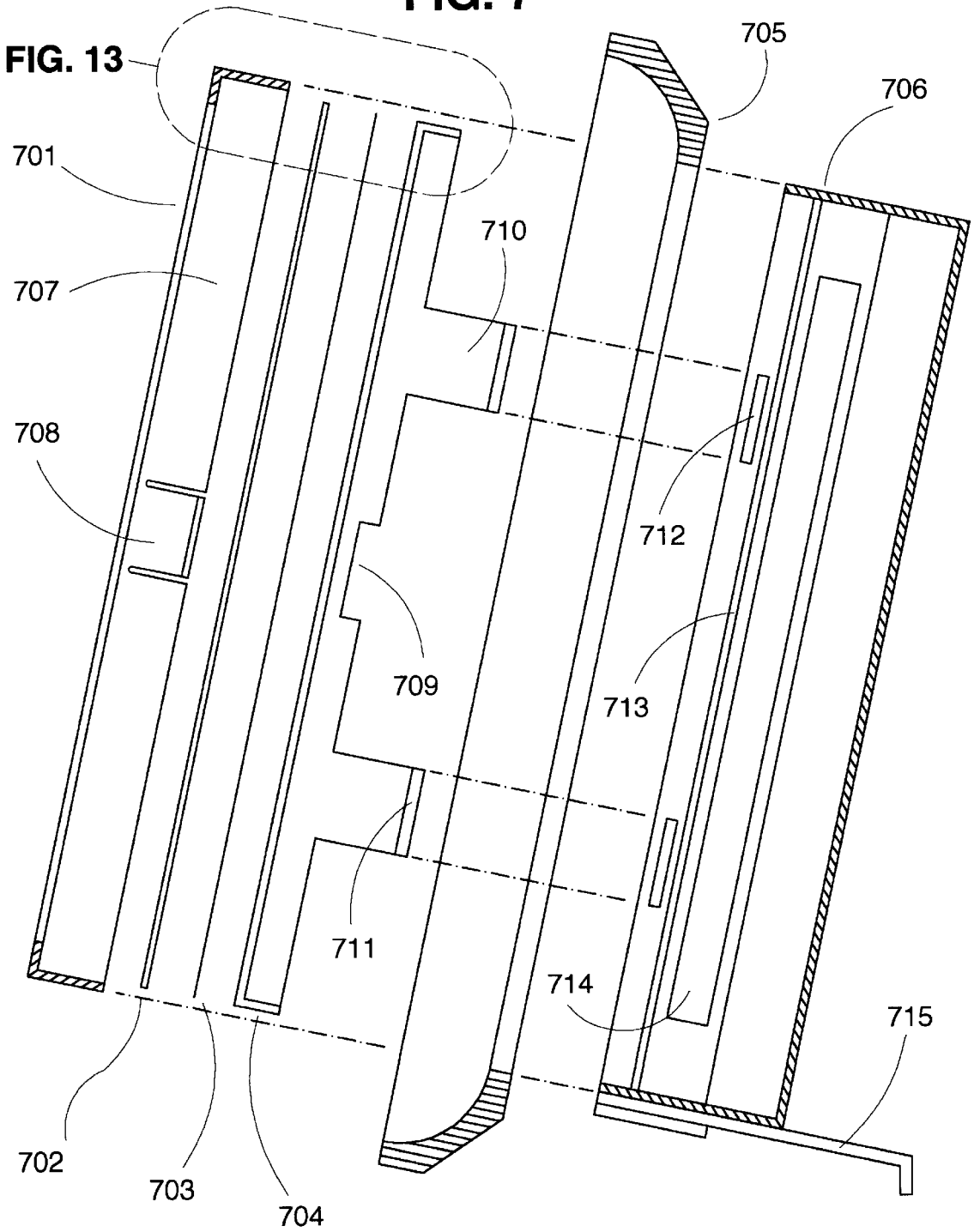
FIG. 7 illustrates a side assembly view of one preferred embodiment of the present invention as shown in FIG. 6.

FIG. 7 illustrates an expanded vertical section as indicated on FIG. 6, demonstrating sequential assembly of major system components to lightbox (706). This view clearly illustrates the media platen retainer (701) and the peripheral reflection zone (707), which is also detailed in FIG. 10 (1007). Means of component attachment are also clearly visible: the platen retainer (701) is secured to the media platen (704) using one or more flexible latch(s) (708) which may be integral to the retainer frame (701) which is slidably received and secured into platen receptor (709). Correspondingly, the media assembly (701, 702, 703, 704), is similarly attached to the lightbox assembly (706) by one or more offset platen support(s) (711) being slidably received and secured into one or more lightbox receptor(s) (712).

Figure 8:
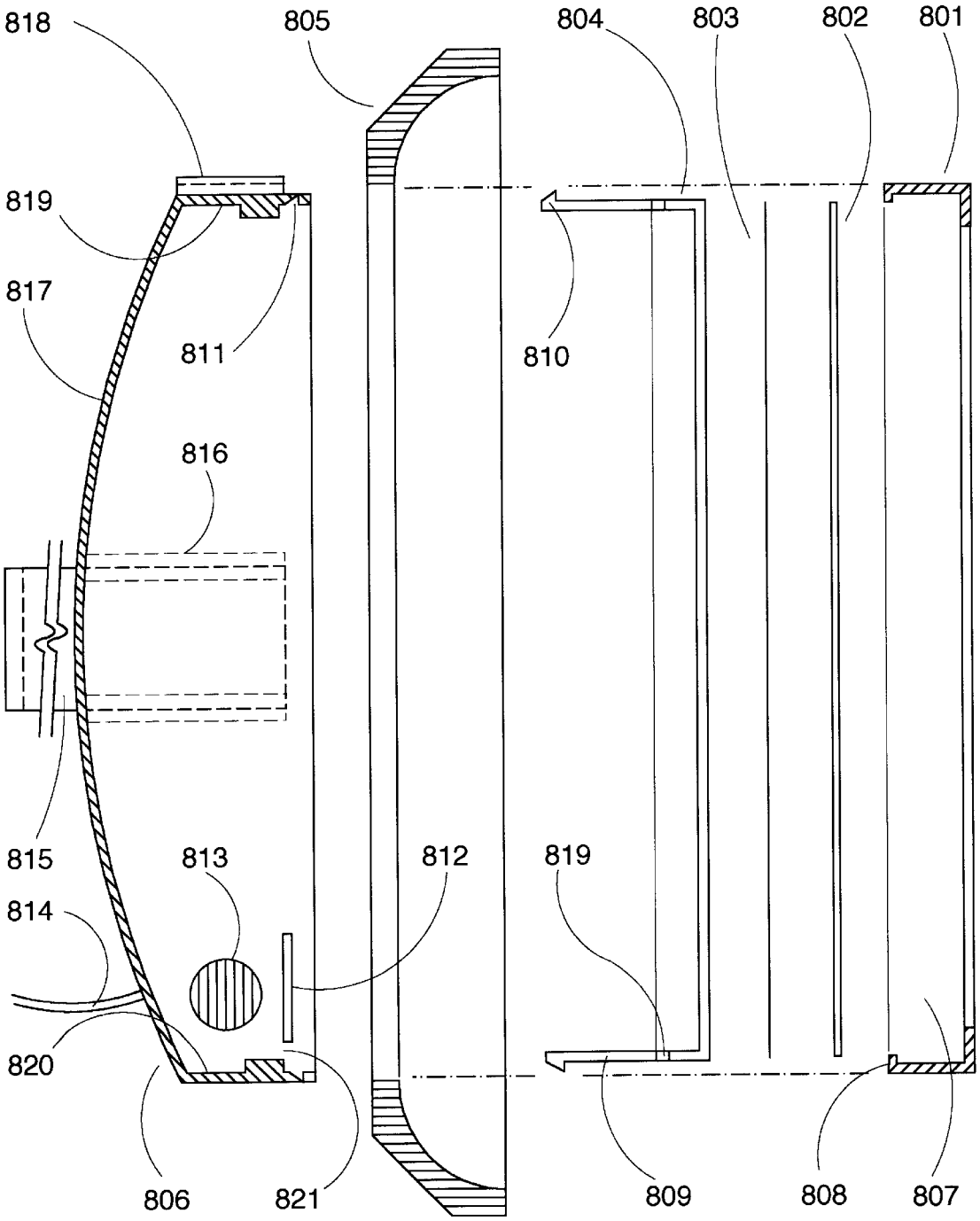
FIG. 8 illustrates a top assembly view of one preferred embodiment of the present invention as shown in FIG. 6.
Figure 9:
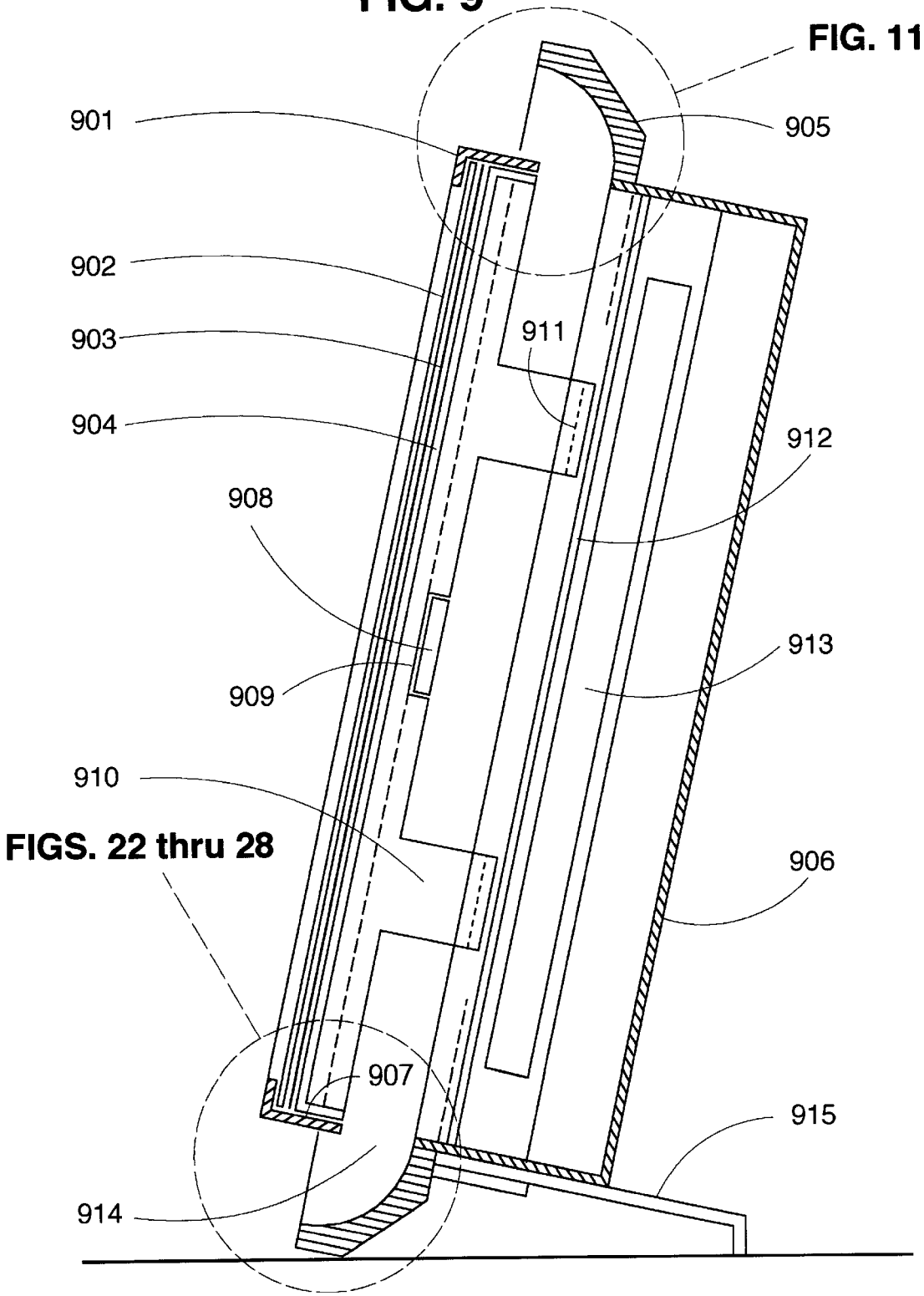
FIG. 9 illustrates a assembled side view the preferred embodiment of the present invention shown in FIG. 6.

FIG. 8 illustrates an expanded horizontal section as indicated on FIG. 6, demonstrating sequential assembly to lightbox (806). This view provides continued understanding of component attachment means (808, 809) as described in FIG. 6. This view also clearly illustrates the placement of an elongated light source (813) at the lightbox sidewall (820) with the light mask (812) positioned in the viewer sight line between the light source and the display media at a distance from the sidewall (820) sufficient to create the compensating light channel (821);

FIG. 9 illustrates an assembled vertical section as indicated on FIG. 6. This view clearly shows the peripheral light passage (914) created by offsetting the display media containment assembly (901, 902, 903, 904), from lightbox assembly (906) as supported by flexible attachments (910).

Figure 10:
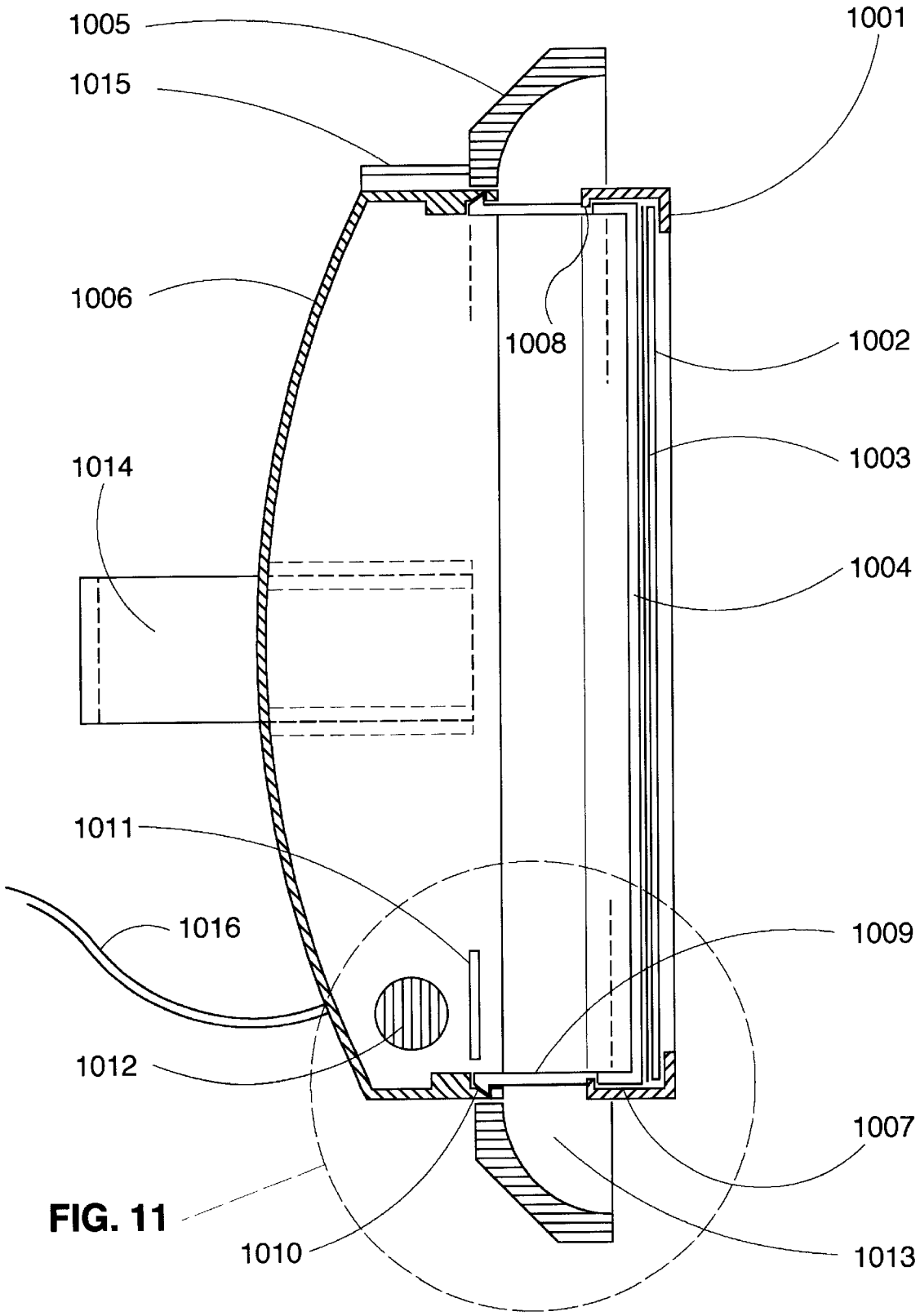
FIG. 10 illustrates a assembled top view of one preferred embodiment of the present invention that is designed for desktop display applications.

FIG. 10 illustrates an assembled horizontal section as indicated on FIG. 6, and details the peripheral light passage (1013) as described in FIG. 9.

Figure 11:
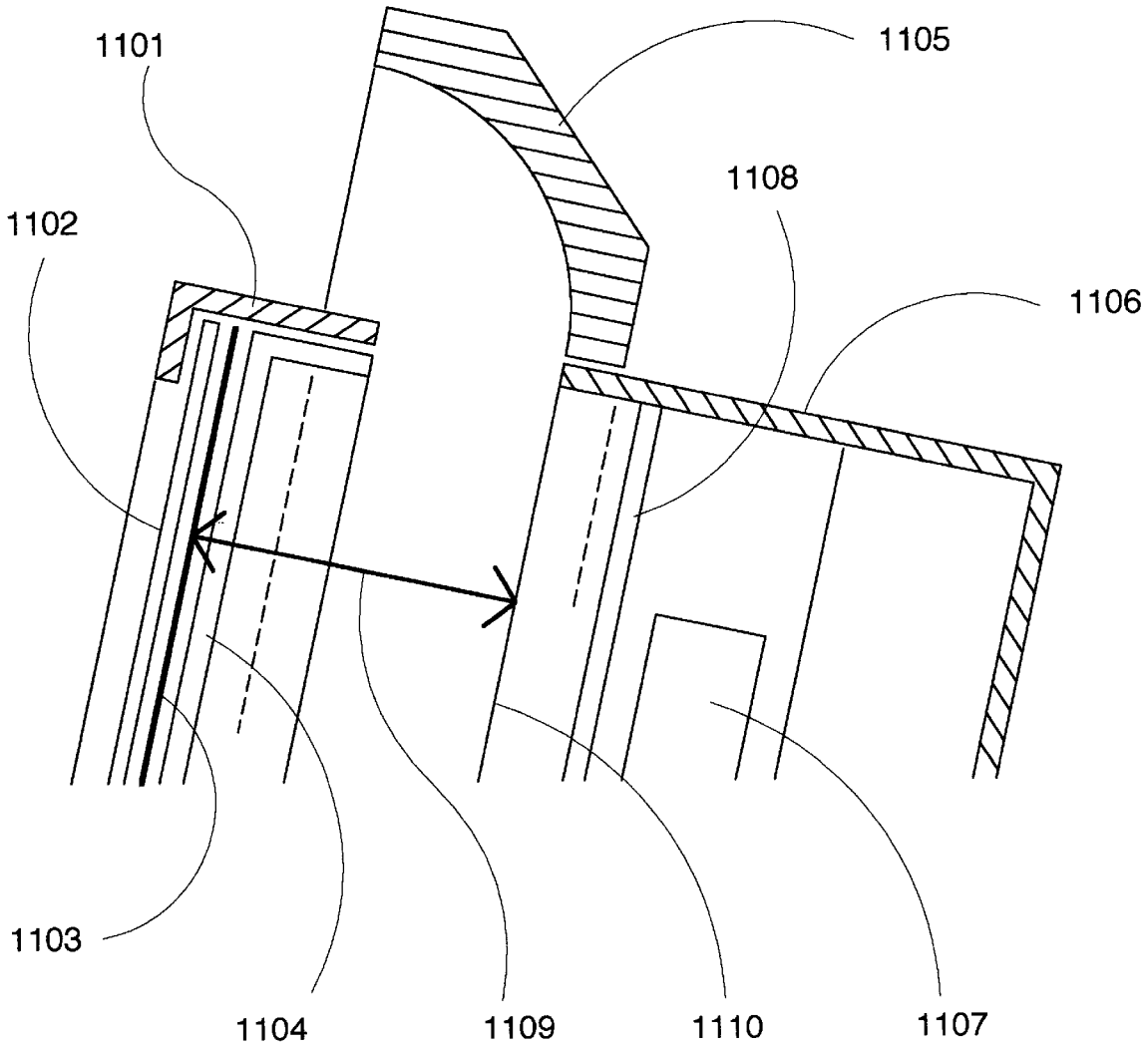
FIG. 11 illustrates a side view of the construction details of an exemplary embodiment of the present invention shown in FIG. 9.

FIG. 11 illustrates a side view of the construction details of an exemplary embodiment of the present invention shown in FIG. 9, and shows the spatial relationship (1109) between the display media (1103) in relation to the plane of the decorative frame (1110). This exemplary embodiment of the present invention permits front installation of the display media.

Figure 12:
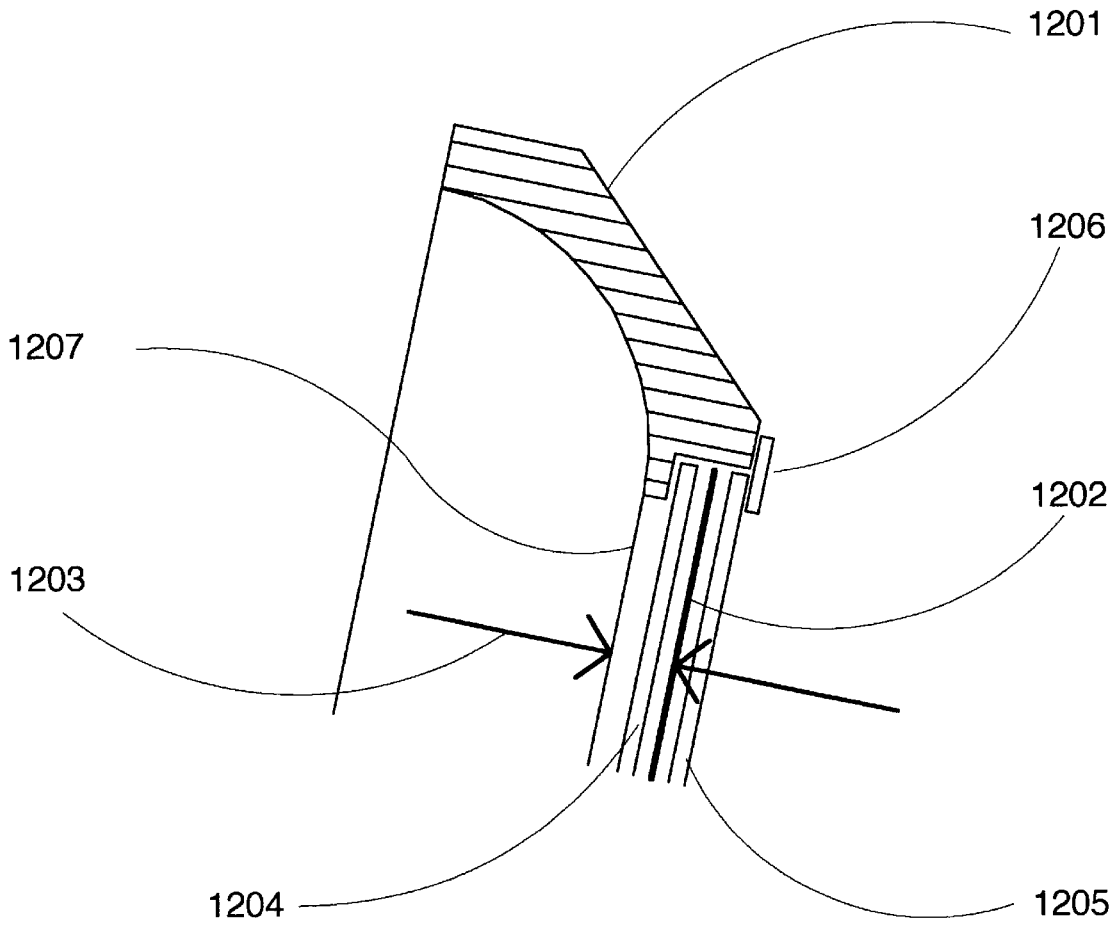
FIG. 12 illustrates a side view of the construction details of a conventional prior art decorative frame.

FIG. 12 illustrates a side view of the construction details of a conventional prior art decorative frame, showing the relationship between (1203) between the display media (1202) in relation to the plane of the decorative frame (1201). In contrast to FIG. 11, the display media for conventional frames of this type must be installed from the rear.

Figure 13:
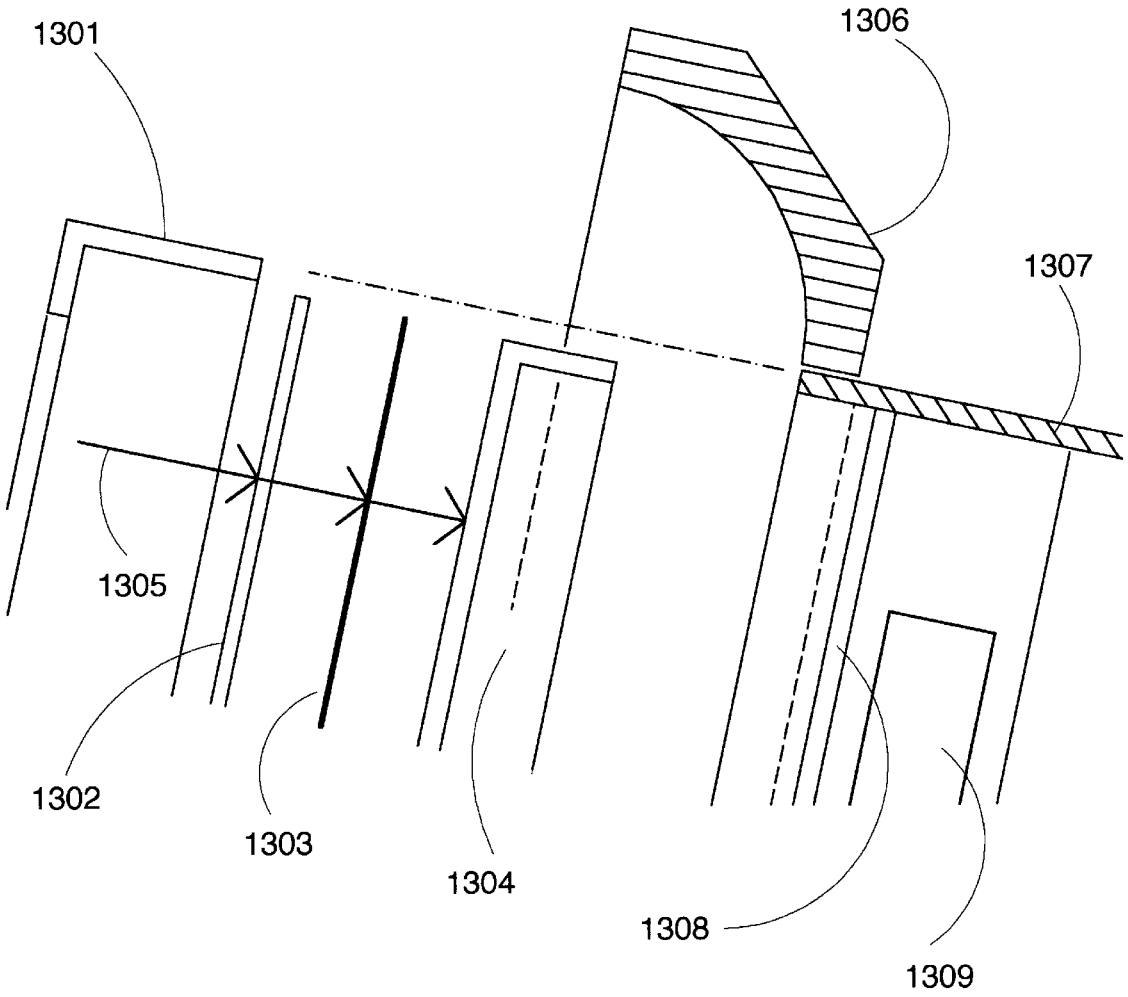
FIG. 13 illustrates a side view of the assembly details of an exemplary embodiment of the present invention shown in FIG. 7.

FIG. 13 illustrates a side view of the assembly sequence details of an exemplary embodiment of the present invention shown in FIG. 9, and shows the relationship (1305) between the display media (1303) in relation to the plane of the decorative frame (1306). This exemplary embodiment of the present invention permits front installation of the display media.

Figure 14:
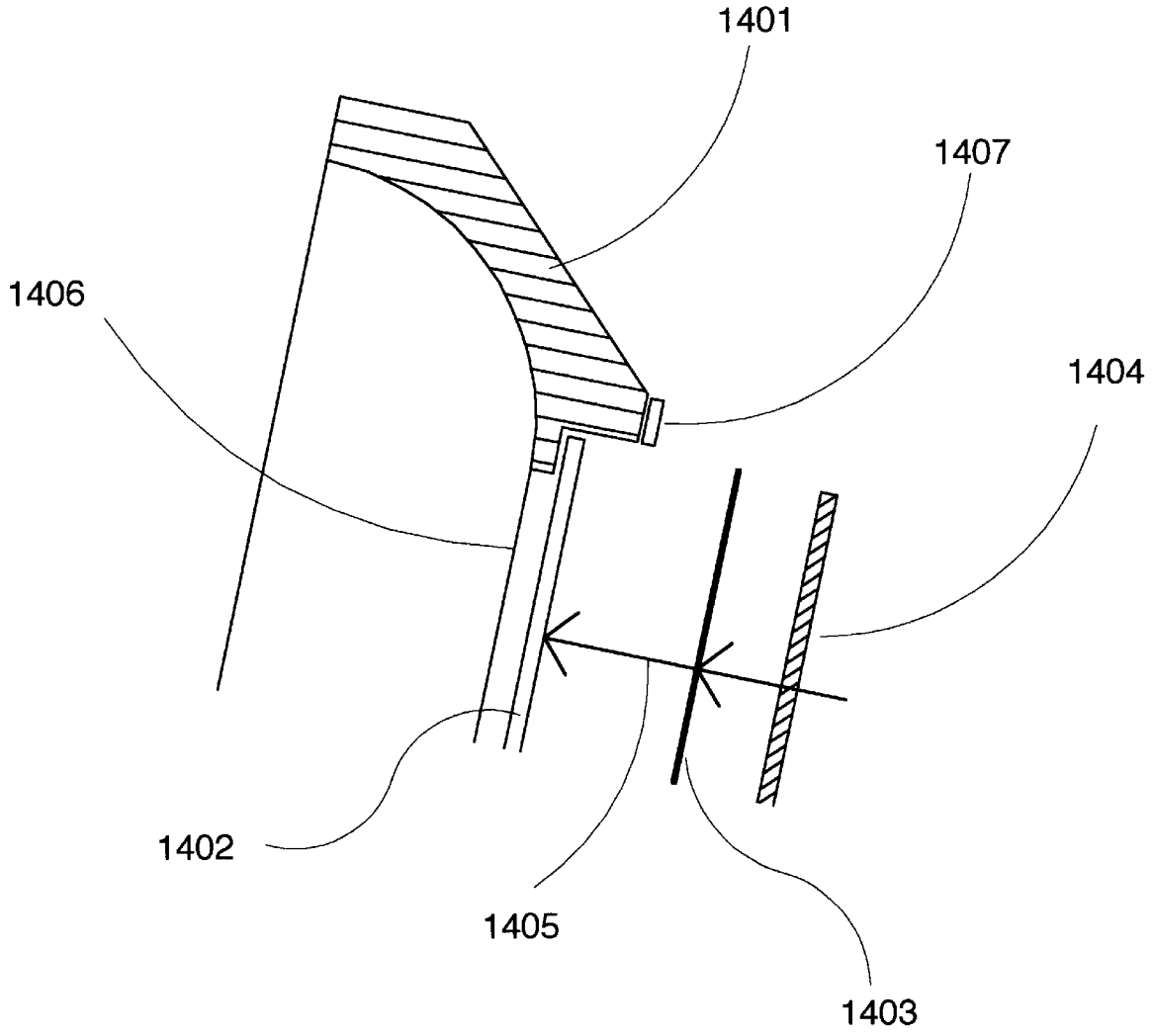
FIG. 14 illustrates a side view of the assembly details of a conventional prior art decorative frame.

FIG. 14 illustrates a side view of the assembly sequence of a conventional prior art decorative frame, showing the relationship between (1405) between the display media (1403) in relation to the plane of the decorative frame (1406). In contrast to FIG. 13, the display media for conventional frames of this type must be installed from the rear.

Figures 15, 16, 18:
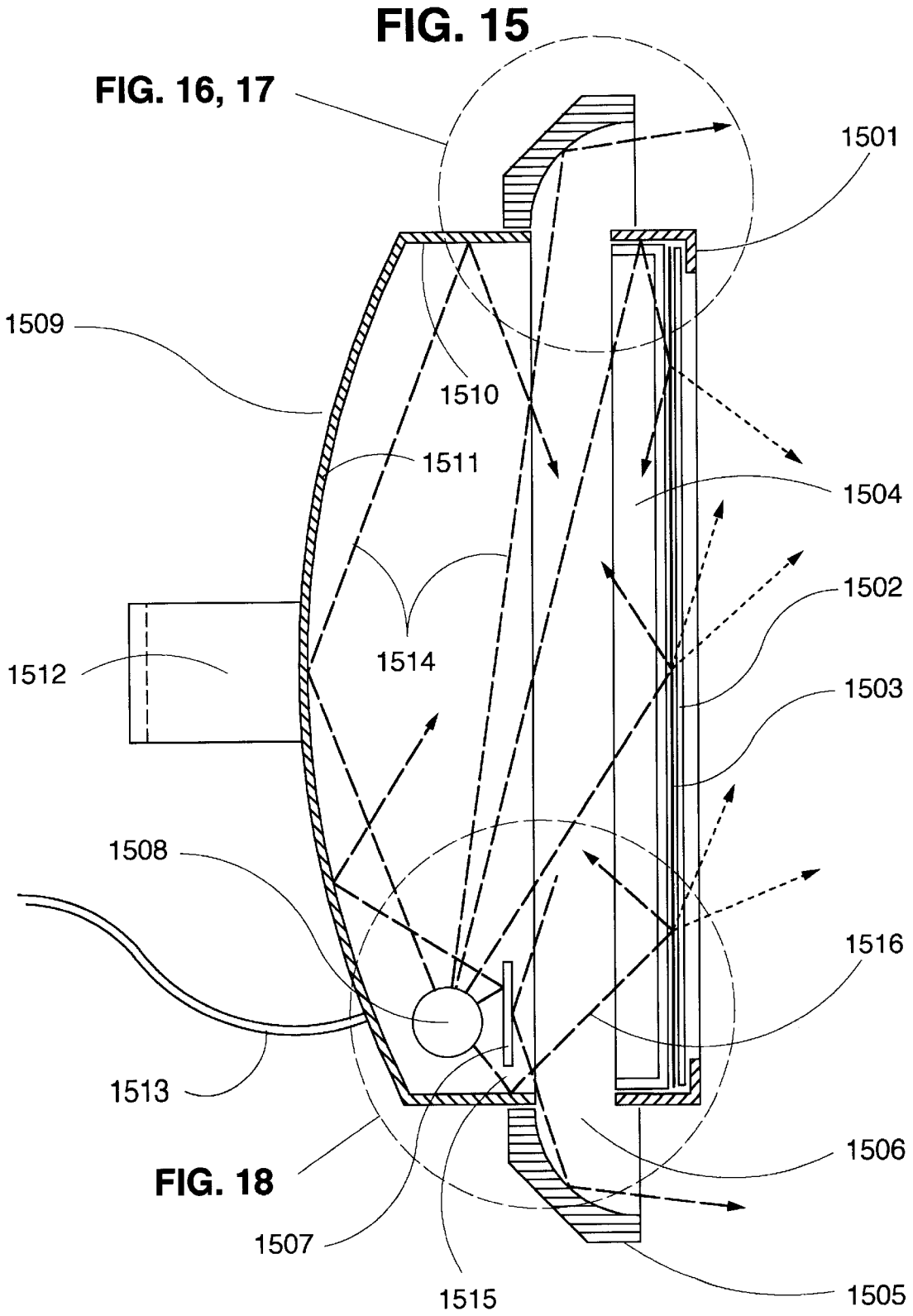
FIG. 15 illustrates typical light source and masking trajectories for one preferred embodiment of the present invention.
FIG. 16 illustrates typical frame light trajectories for the embodiment of the present invention shown in FIG. 15.
FIG. 18 illustrates a detail of typical light source and masking trajectories for a preferred embodiment of the present invention.
Figure 16:
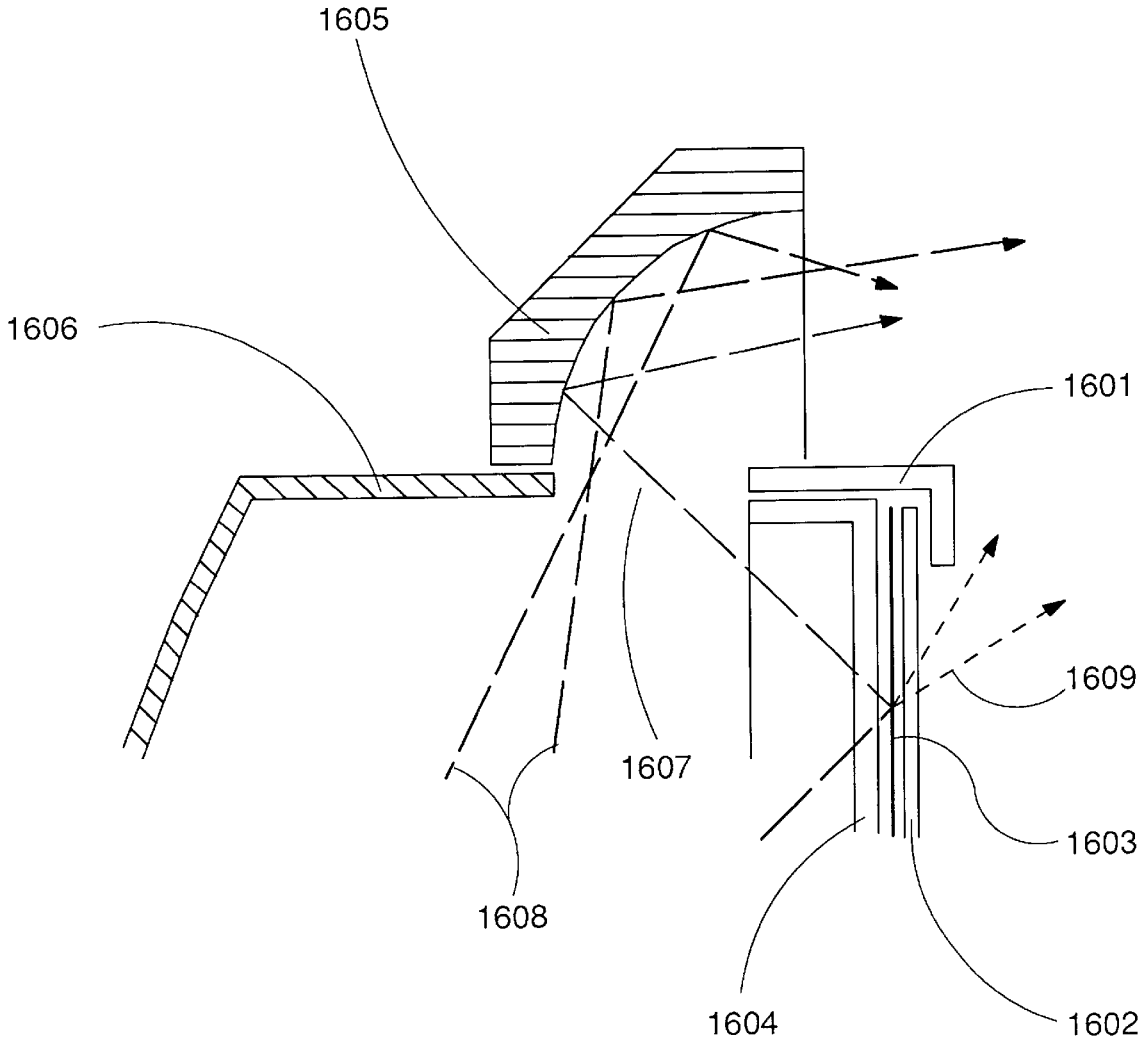

FIG. 15 illustrates the fact that reflection of ambient illumination originating from a singular light source is a simple and cost-effective means to generates unique and uniform backlighting media display appearance. The generalized light source vector lines illustrate illumination paths to illuminate the display media (1502) and the decorative frame (1505) as reflected off the lightbox rear panel (1509), major sidewalls (1510), light source mask (1507), and retainer reflection zone (1504).

FIG. 16 illustrates light source illumination of the decorative frame (1605) through the unique peripheral passage (1607) created by the offsetting structure.

Figure 17:
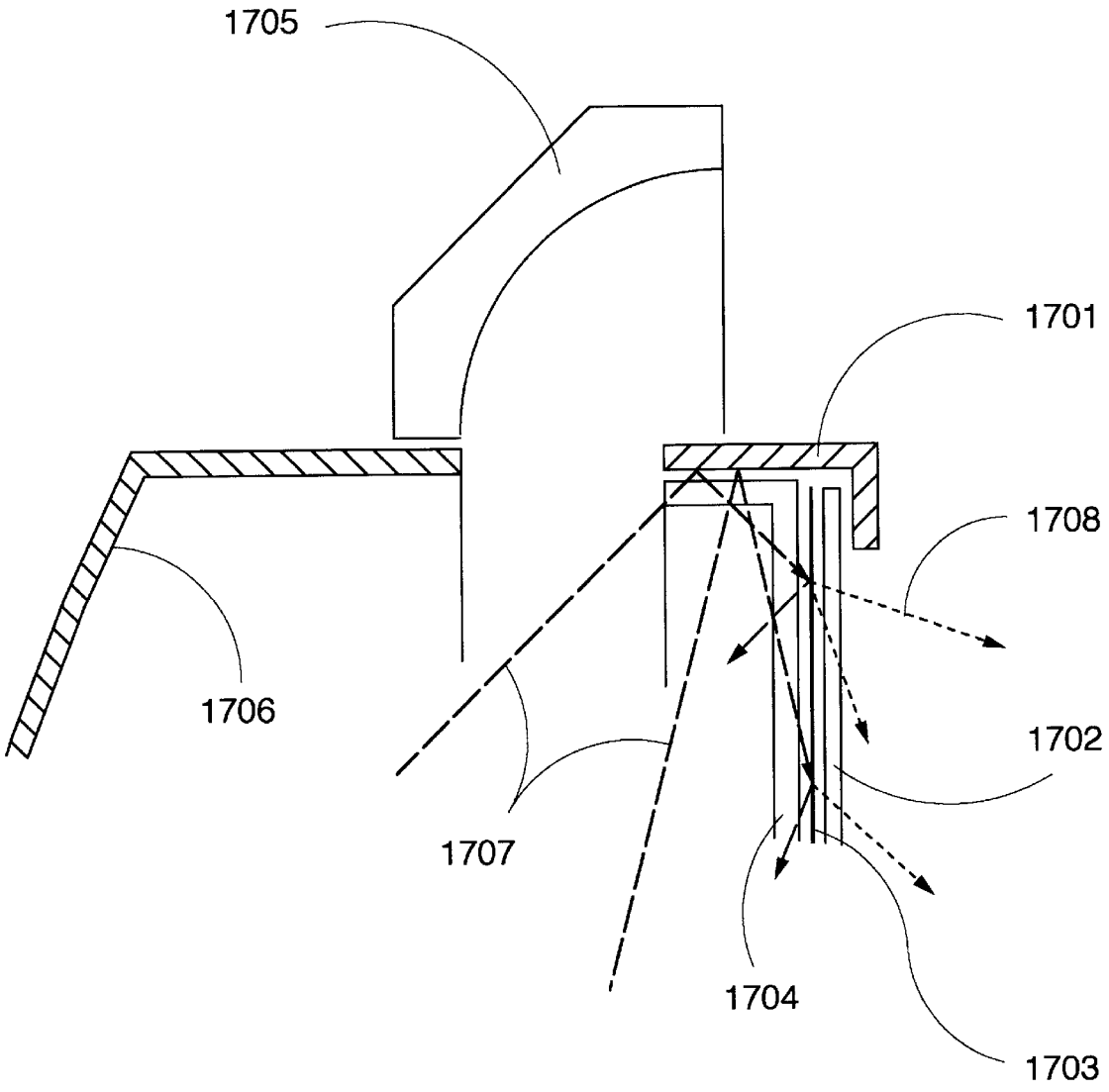
FIG. 17 illustrates typical media containment light trajectories for the embodiment of the present invention shown in FIG. 15.
Figure 18:
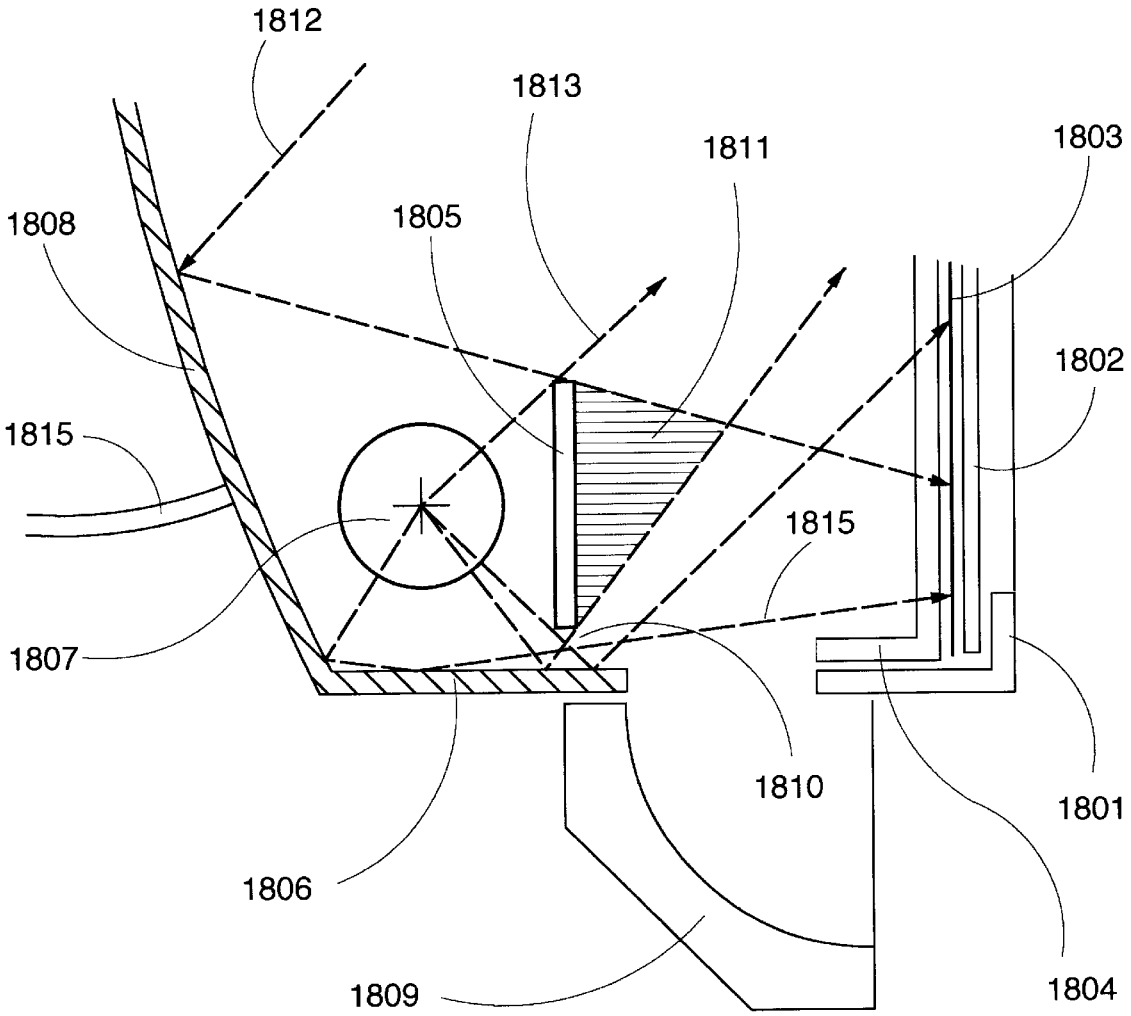

FIG. 17 illustrates isolates the functionality of the retainer reflection zone (1701).

FIG. 18 illustrates the functionality of the opaque light mask (1805) as located at a distance from the lightbox sidewall (1806) sufficient to create a passage (1810) for the unique compensating illumination necessary to reduce the shadow cast by the opaque light mask and thereby eliminating any disruptions to the uniform illumination of the display media.

Figure 19:
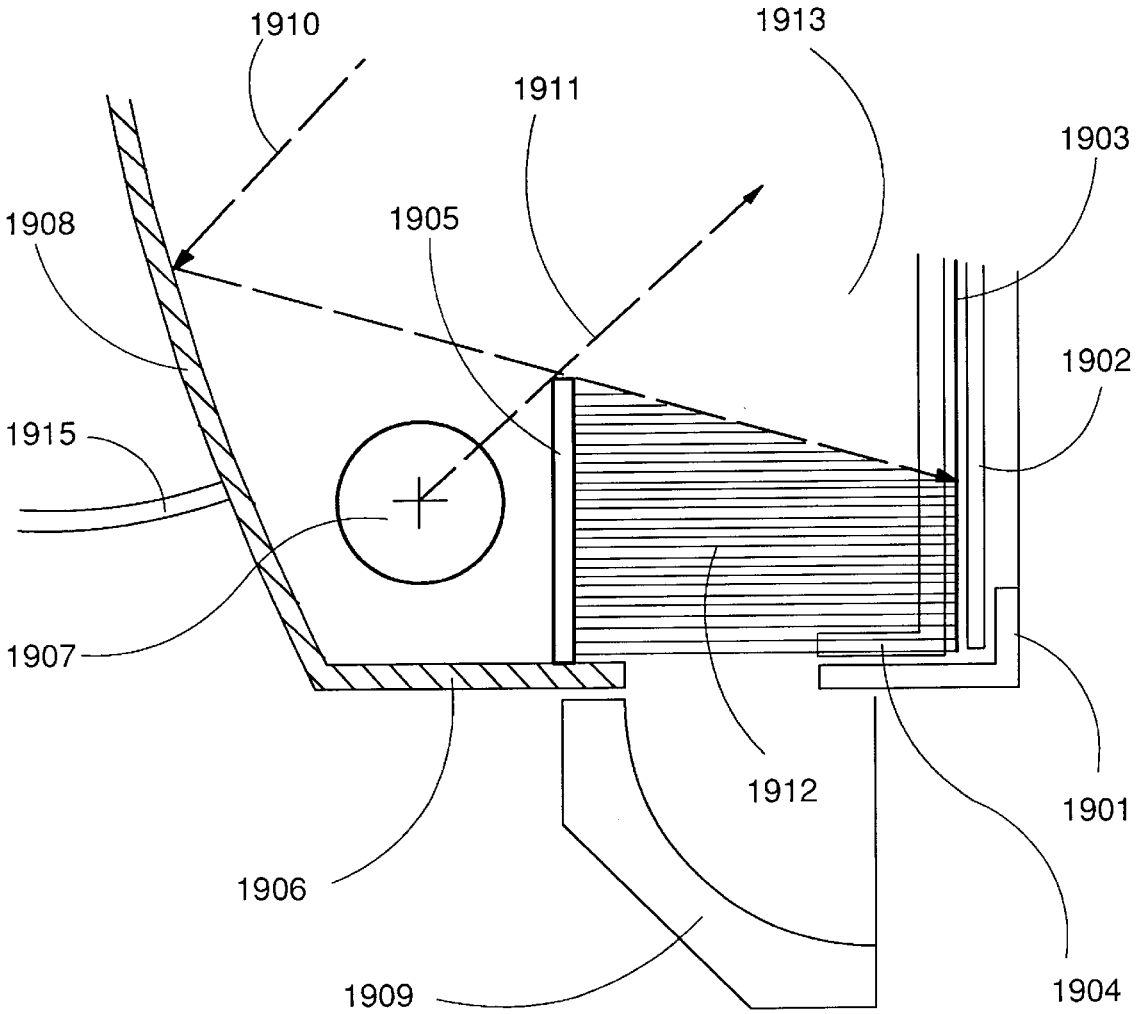
FIG. 19 illustrates improper light source masking trajectories for a preferred embodiment of the present invention.

FIG. 19 demonstrates the shadow cast on the back of the display media if the referenced compensating passage (FIG. 18, 1810) is not provided.

System Assembly

Referencing the exemplary embodiment illustrated in FIG. 5, assembly of a presently preferred embodiment of the invention starts with the display media container (502) which has a retainer frame (505) which covers the protective glazing (506) that fixes the display media (507) to the media platen (508). The retainer frame (505) may contain one or more flexible catches (510) which mate with corresponding receptor notches (511) in the media platen (508). Note that the retainer frame (505) and the protective glazing (506) may optionally be integrated into a single protective frame structure (501) for ease of assembly.

The media platen (508) may incorporate one or more offset structures (509) to permit the display media (507) to be separated from the plane of the back of the decorative frame (503) and the front edge (520) of the lightbox (504). In the preferred embodiment the offset structures (509) have retaining tongs (extensible projections or the like) which mate with corresponding tong indentations (receptive members) in the lightbox to secure the tongs to the lightbox and thus fix the position of the lightbox (504) to the display media (507). This relationship is detailed in FIG. 8 by the exemplary tong embodiment (810) and exemplary tong indentation embodiment (811).

The optional decorative frame (503) is positioned between the media platen (508) and the lightbox and serves to provide an aesthetically pleasing surround for the display media (507). This effect is further enhanced by the backlighting of the display media via the use of one or more lamp illumination sources (512) whose radiation patterns have been modified via the use of one or more lamp shields (513). To aid in this process, the back of the lightbox (515) is curved to promote backscattering of lamp illumination and thus provide a uniform illumination of the display media (507).

The decorative frame is typically fastened to the lightbox, using staples, screws, mounting hardware, or the like. It will be clear to one skilled in the art that there are a wide variety of methods to implement this fastening operation. Thus, the lightbox (504) provides a support structure on which most of the system components are attached.

As mentioned previously, the backlighting assembly may be optionally supported on a rectangular axis of the lightbox by means of a prop stand (514). Prop stand channel(s) (519) may be incorporated into the lightbox to permit orientation on either major axis (516). Power to support the lighting system (512) may optionally be supplied via an external power cord (518).

Detailed Component Description

Display Media

The present invention is generally designed to provide for the exposure of a translucent or transparent display media, for instance a standard photographic print. It is envisioned that a wide variety of graphic materials may be used within this display context.

While the display media is not per se a part of the present invention, it is instructive to speak to the qualities of the display media which will be amenable for use in the present invention. The thrust of the present invention is targeted towards the display of photographs in a backlit environment. While the present invention performs admirably at this task, there are other media types which will lend themselves to this type of display.

Notably, any transparent or translucent material which either transmits light or which does not transmit visible light may be used in the present invention. In fact, the present invention envisions embodiments in which the display media does not permit light transmission, but the display frame accommodates this by a special construction which permits backscattered light to reflect off the decorative display frame and illuminate the display media in a peripheral manner. Exemplary embodiments of this technique are illustrated in FIG. 26 and FIG. 27. FIG. 26 illustrates an embodiment in which illumination to light the display media is obtained from both the backscattered lightbox illumination and the decorative frame. FIG. 27 shows another embodiment in which illumination to light the display media is obtained from the backscattered lightbox illumination. This particular embodiment permits the relative offset between the display media and the decorative frame to be minimized or eliminated in some circumstances.

Note that nothing in this disclosure should limit the scope of the types of media which may be used with the present invention. While the presently preferred embodiments refer to planar media, nothing in this disclosure or the scope of the invention should so limit the scope of the teachings of this invention. For example, it is possible that the display media may be three dimensional or one dimensional in nature.

Thus, from the foregoing, it should be apparent to one skilled in the art that the present invention does not per se require the installation of display media as an element of its construction, and furthermore that a wide variety of display media types are suitable for use with the present invention.

Display Media Container

As illustrated in the side view of FIG. 7, the display media container typically comprises a retainer frame (701), a protective glazing (702), and a media platen (704) which sandwich and secure the display media (703).

Retainer Frame

Referencing the exemplary embodiment illustrated in FIG. 7, the retainer frame (701) serves the function of securing the protective glazing (702) and the display media (703) to the media platen (704) via flexible catches (708) in the side (707) which mate with corresponding receptor notches (709) in the media platen (704). The retainer frame (701) is typically formed of a metallic and/or plastic composition, but other compositions are possible consistent with the teachings of this invention.

As mentioned previously, the retainer frame (701) may be integrated with the protective glazing (702), or in some circumstances the protective glazing may be completely omitted from the invention embodiment. Similarly, the retainer frame (701) may be integrated with the media platen (704), eliminating the need for two-piece assembly of this structure. Notably, the construction configuration of FIG. 7 has the advantage of permitting easy and rapid front access to the display media for placement and/or replacement purposes.

As illustrated in FIG. 22, FIG. 23, FIG. 24, and FIG. 25, the retaining frame (2202, 2302, 2402, 2502) may take on a wide variety of configurations consistent with the teachings of the present invention. Note that in many cases the retaining frame will be aesthetically matched to the decorative frame design (2203, 2303, 2403, 2503). This correspondence will be easily understood by one skilled in the art, permitting a wide variety of retaining frame and decorative frame combinations to be constructed given the teachings of the present invention.

Protective Glazing

Referring to FIG. 7, the protective glazing (702) is typically a sheet of a clear rigid material (glass, plastic, acrylic, or the like) matching the area dimensions of the media platen (704) and sufficiently thick to uniformly press the display media (703) to the media platen (704).

Note that in some applications the protective glazing (702) may be colored, translucent, and/or textured to generate visual effects complementary to the display media. Examples of this include protective glazings which are bordered, those that only cover a portion of the display media, and those which apply special visual effects to the display media. One skilled in the art can no doubt generate numerous other combinations consistent with the teachings of the present invention.

Media Platen

Referring to FIG. 7, the clear media platen (704) provides the foundation (backing) against which to secure and/or support the display media (703) and the protective glazing (702). This functionality is similar in function to that of a printing press platen. The media platen (704) is generally formed of a uniform clear rigid plastic or the like, and permits light transmission so as to allow illumination of the display media from the lightbox.

While illustrated embodiments of the media platen have a support backing covering the entire back of the display media (703), other variations are possible in which only a portion of the display media is supported by the media platen. A preferred embodiment of the media platen (704) forms a continuous sheet surface matching the dimensional area of the intended display media, to provide maximum backing support for the display media (703).

Offsetting Structure

Referencing the exemplary embodiment illustrated in FIG. 7, the offset structure (710) has as its primary function the separation of the media platen from the lightbox to permit peripheral illumination of the decorative frame (705). The offsetting structure (710) is typically formed from as part of the media platen (704), but may be configured as a separate means of supporting and separating the media platen (704) from the lightbox (706).

In the invention embodiment illustrated in FIG. 7, the offsetting structure (710) is configured with tongs (711) which mate with corresponding indentations (712) in the lightbox, thus permitting attachment of the media platen (704) with the lightbox (706). This offsetting function permits a peripheral light gap surrounding the outside of the media platen (704) and permits illumination of the inside border of the decorative frame (705).

It should be noted here that the term 'tong' or 'tongs' has been used in the exemplary embodiment illustrations to indicate any suitable attachment means which permits the offsetting structure to secure the media container to the lightbox. The present invention envisions a wide variety of potential embodiments, including but not limited to pliars, pincers, extensible structures, flexible projecting structures, and the like which one skilled in the art would have no trouble in fabricating to affect this offsetting functionality.

Decorative Frame

The decorative frame comprises a continuous swept/lathed/extruded section of any angular or curvilinear shape to the desired angular segmentation with the interior opening corresponding to and over fitting the lightbox enclosure (517). Swept/lathed/extruded material can be of any moldable composition, including, but not limited to: wood, plastic, acrylic, metal, ceramic, plaster, glass or other organic, or inorganic composition.

Lightbox Enclosure

Referencing the exemplary embodiment illustrated in FIG. 7 and FIG. 8, the lightbox enclosure assembly (706, 806) contains one or more elongated light sources (714, 813), a light mask (713, 812) and is the foundation framework to which the majority of the other system components are attached and supported. The lightbox enclosure (706, 806) is generally a five sided volume with a major side open facing the back of the display media (703, 803) and oriented towards the viewer.

Opposite the open face of the lightbox enclosure (706, 806), is the rear backscattering reflector (817), which is formed in a concave curvature extending in a substantially cylindrical manner along the major axis of the lightbox.

Referencing the exemplary embodiment illustrated in FIG. 5, side panels (516) extend along the length of the major axis at the sides of the lightbox (504). Curved panels (517) that conform to the rear backscattering reflector (515) curvature close off the lightbox enclosure ends. One or more light sources (512) are positioned within the lightbox in the corner to provide a source of backlighting illumination. These light source(s) are typically positioned equidistant from the adjacent side panel and the rear backscattering reflector (515). One preferred embodiment of the invention uses a single light source (512).

A light mask (513) is typically positioned parallel to the light source bulb and separated from the adjacent sidewall to create a compensating channel permitting uniform light distribution over the back of the display media (507).

An optional prop stand (514) slides interchangeably into one or more attachment channels (519) located on one or more sidewalls (516) and one or more end panels (FIG. 8, 816, 818).

Theory of Operation

Overview

Referencing a preferred embodiment of the present invention as illustrated FIG. 15, an analysis of the performance characteristics of the present invention will now be discussed.

The light source (1508) is positioned to one side of the lightbox and generally radiates illumination in all directions. However, the effective radiation pattern of the light source (1508) is highly modified by the simultaneous use of a light mask (1507) and a curved backscattering device (1509) which is configured as the back portion of the lightbox.

Illumination rays from the light source (1508) normally would produce 'hot spots' of illumination on the back of the display media (1503) as occurs in prior art implementations such as taught by the Fogelberg, et. al. patent because the radiation intensity I(r) for a cylindrical illumination source is given by the relation $$I(r) \propto \frac{1}{r^2} \tag{2}$$

where r≡distance from radiation source

Thus, the illumination intensity is a nonlinear function of the distance from the light source (1508). Unfortunately, this nonuniformity cannot be adequately compensated for by the use of special curvatures applied to the back of the lightbox, notwithstanding the teachings of the Fogelberg, et. al. patent.

The present invention attacks the problem of illumination nonuniformity via a variety of methods, including:

1The light source (1508) is positioned to one side of the lightbox so as to permit the back and sides of the lightbox to act as a backscattering device to disperse the illumination from the light source (1508) throughout the cavity of the lightbox.

2. The present invention curves the back of the lightbox to enhance the scattering effect of the light that is produced by the light source (1508).

3. A light mask (1507) is used to reduce the effect of illumination 'hot spots' and reflect incident illumination back into the lightbox cavity.

4. A light channel (1515) is positioned adjacent to the light mask (1507) to permit some illumination (1516) to escape the masking process and impinge on the display media (1503), thus permitting the elimination of hot spot illumination by balancing the masking effects of the light mask (1507) with the illumination generated by the light channel (1515).

5. Sides of the lightbox (1510) are specifically designed to reflect light back into the lightbox cavity.

6. Sides of members constituting the display media container, such as the retainer frame (1501), are designed to reflect light onto the back surface of the display media (1503).

7. Sides and back of the lightbox are generally white or constructed of a material which is reflective to the desired range of illumination frequencies that are used for backlighting.

These features are discussed in more detail in the following sections.

Shared Display Media/Decorative Frame Illumination

As illustrated in FIG. 15, the present invention also permits uniform light to illuminate the decorative frame (1505) as it exits the airspace channels (1506) which surround the display media container. Light illumination (1514)

is therefore shared between the display media (1503) and the decorative frame (1505), permitting a single light source to optionally service both illumination requirements in the present invention.

A detail of this shared illumination feature is illustrated in FIG. 16. Here rays (1608) generated by the illumination source are permitted to impinge the decorative frame (1605) but also may be backscattered (1607) from the back of the display media (1603). Note that the sidewall (1606) construction of the lightbox also contributes to this backscattering effect.

Display Media Container Reflective Sidewalls

FIG. 17 illustrates one embodiment of the present invention in which the retainer frame (1701) is coated to permit reflection of incident illumination (1707) back through the media platen (1704) onto the display media (1703). This embodiment permits additional backlighting illumination (1708) to be emitted through the display media (1703) and the protective glazing (1702).

This coating of the retainer frame (1701) can be in a variety of forms, but a variety of preferred embodiments make use of a white coating or an aluminized reflective coating in this application. Note that the reflective nature of the retainer frame functions in a manner similar to the reflective nature of the backscattering portion of the lightbox (1706).

Light Mask

Referencing the exemplary embodiment illustrated in FIG. 18, the light mask (1805) has the purpose of modulating the light source (1807) intensity to permit a uniform light intensity to be present at the portion of display media (1803). Without the presence of the light mask (1805), there would exist a region of high intensity illumination at the surface of the display (1802).

However, complete shielding of the light source as illustrated in FIG. 19 produces just the opposite effect. Instead of an illumination "hot spot", the configuration of FIG. 19 produces a 'cold spot' (1912) of reduced illumination at the front of the display (1902). The solution to this problem achieved by the present invention and illustrated in FIG. 18 is the incorporation of a light channel (1810) which permits light rays (1812, 1815) to traverse past both edges of the light mask (1805) and thus reduce the illumination shadow (1811) projected by the light mask (1805). The gap produced by the light channel (1810) permits backscattered radiation from the sides (1806) and back (1808) to pass the light mask (1805) and illuminate the back of the display media (1803).

Preferred embodiments of the present invention have utilized a solid light mask which is white or reflective in color. However, a wide variety of light masks may be suitable for this application, depending on the strength of the light source, size of the backlit display, and a variety of other dimensional construction factors. Thus, it is envisioned that in some embodiments the light mask may not be opaque, but could in some circumstances be gridlike or composed of other semi-transparent or semitranslucent material which performs the required masking function to effect uniform illumination across the media display. Therefore, one skilled in the art will recognize that a wide variety of materials can be made suitable for use as a light mask in this application.

Curved Lightbox Back

Figure 20:
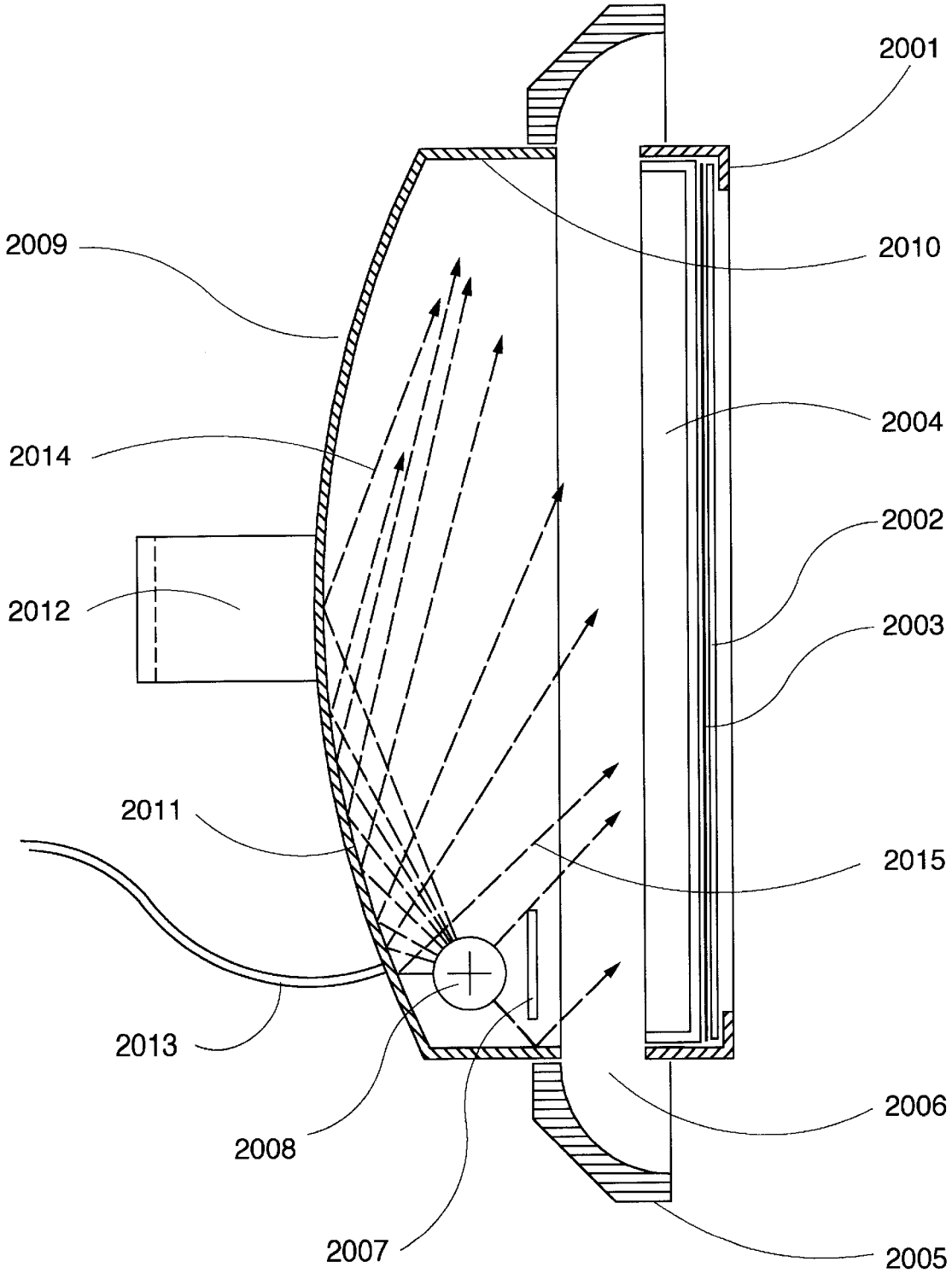
FIG. 20 illustrates typical light source and masking trajectories for a preferred embodiment of the present invention and shows the operation of the light channel.
Figure 21:
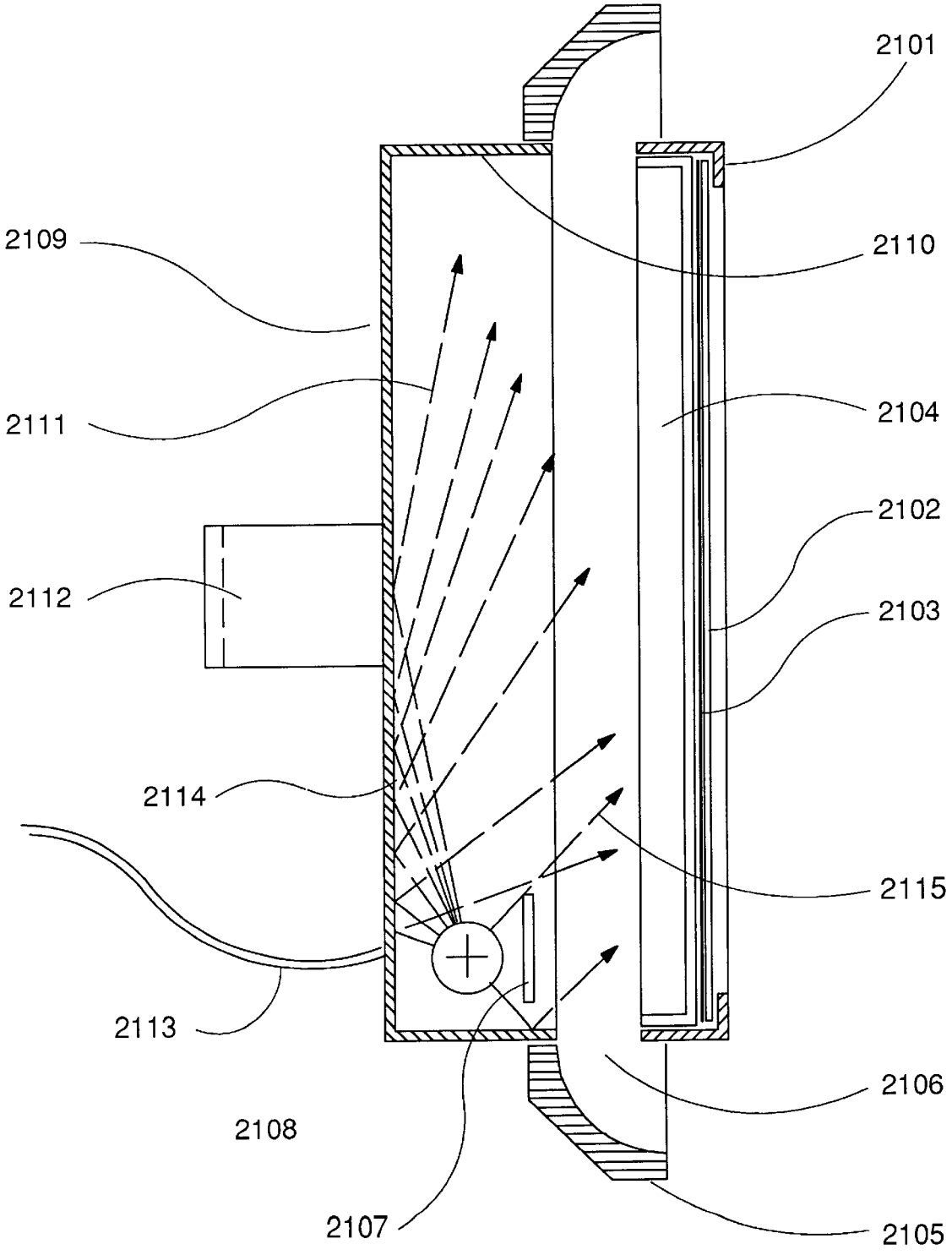
FIG. 21 illustrates improper light source and masking trajectories for a backlighting scheme which does not perform to the same level as the preferred embodiments of the present invention.
Figure 22:
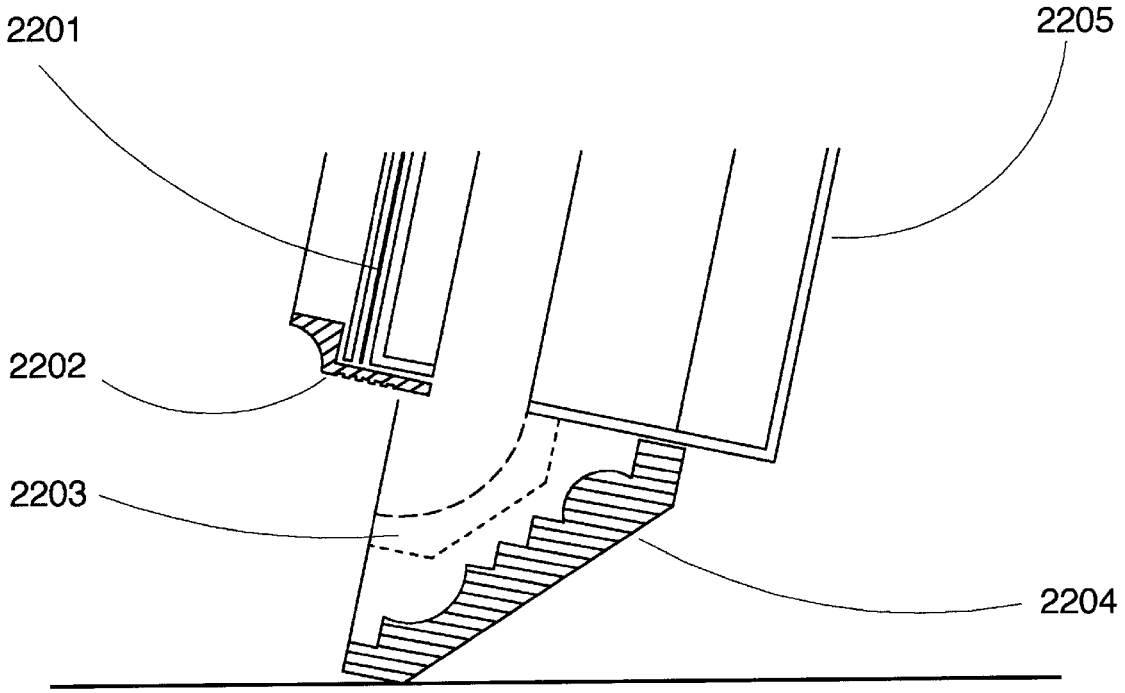
FIG. 22 illustrates a side view as referenced in FIG. 9 of an example of one exemplary embodiment of a preferred ornamental frame for use in embodiments of the present invention.
Figure 23:
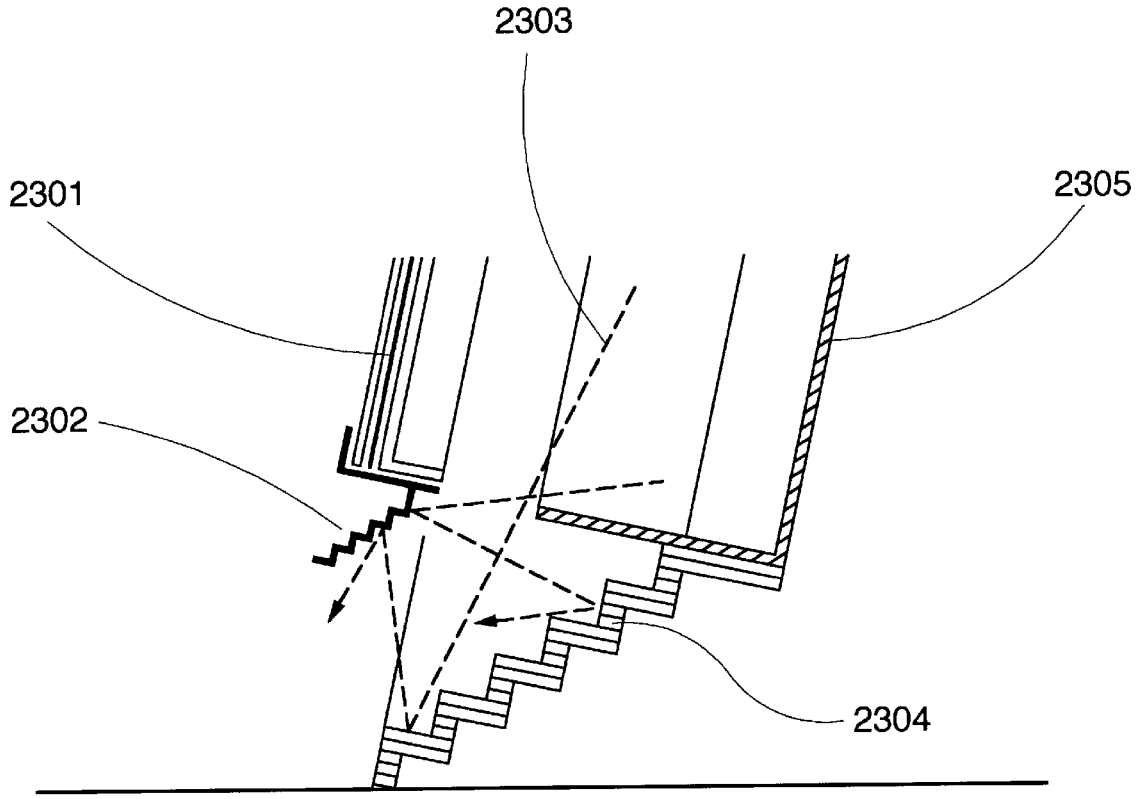
FIG. 23 illustrates a side view of an example of one exemplary embodiment of a preferred ornamental frame for use in embodiments of the present invention and the inter-reflective light trajectories associated therewith.

Referencing the exemplary embodiment illustrated in FIG. 20, the present invention preferred embodiments utilize a curved back face (2011) of the lightbox (2009) to act as a backscattering device for the illumination generated by the light source (2008). Note that this configuration is preferred because straight-backed lightbox configurations such as shown in FIG. 21 tend to produce a nonuniform backlighting of the display media which causes a concentration of light source illumination in the vicinity of the light source thereby aggravating a nonuniform illumination by causing 'hot spots'. While in some circumstances this may be desirable, in the vast majority of applications the desired result is a uniform backlighting effect, making FIG. 20 the preferred construction method.

A curved backscattering panel (2011) results in less light source distribution in the vicinity of the light source, while directing a larger amount of radiant energy to the opposite sidewall and associated reflection zone. This construction creates greater inter-reflection and better overall light distribution at the back face of the display media. In contrast, FIG. 21 illustrates a greater concentration near the light source and less energy directed towards the opposite sidewall and reflection zone, thereby creating a less efficient and irregular light pattern distribution.

As to the curvature of the lightbox back (2011) shown in FIG. 20, this depends heavily on the size of the lightbox, the size and intensity of the illumination source (2008), and the exact positioning of the illumination source and its corresponding light mask (2007). It is thought that the uniform curvature of the present embodiment provides both the best illumination characteristics as well as the most pleasing visual lightbox design as contrasted with the prior art designs which have opted for nonuniform curvatures in their attempt to achieve uniform illumination characteristics.

Decorative Frame Variations

Obviously, the construction of the decorative frame can have a significant impact on the appearance of the overall backlit display using the presently disclosed invention. FIG. 22, FIG. 23, FIG. 24, and FIG. 25 illustrate just a few of the potential embodiments of the present invention with respect to variations in decorative display frame.

Figure 24:
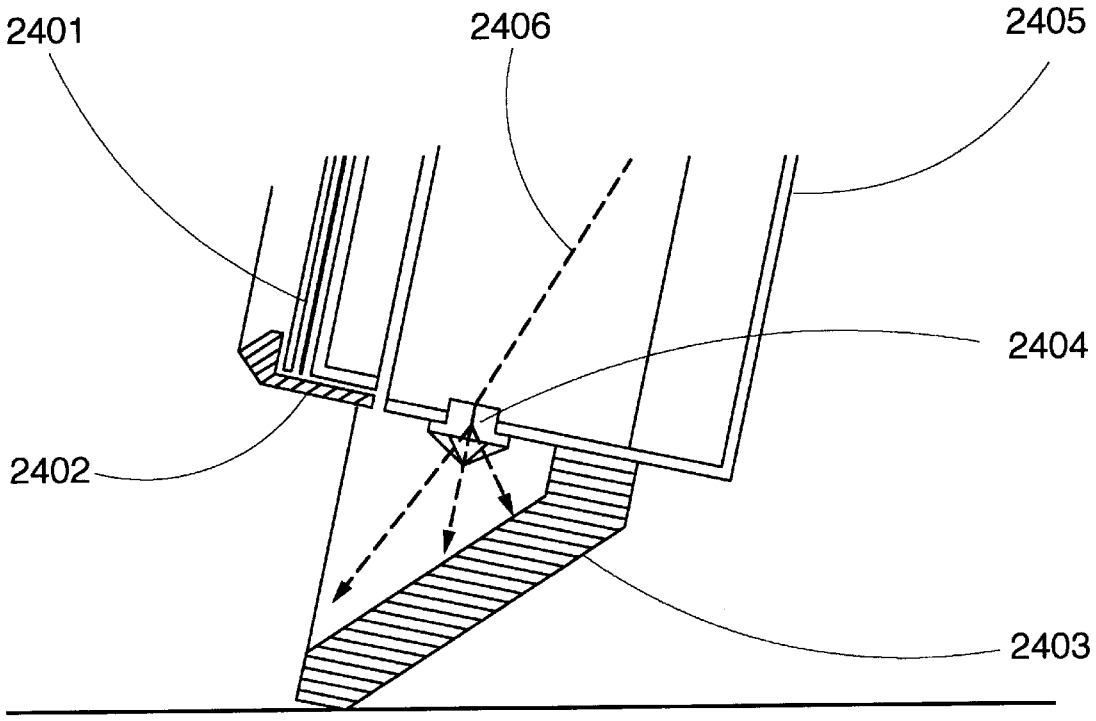
FIG. 24 illustrates a side view of an example of one exemplary embodiment of a preferred ornamental frame for use in embodiments of the present invention and the specular light trajectories associated therewith.

It is significant to note that FIG. 24 illustrates that the lightbox (2405) may be augmented with one or more light conduits and/or passages (2404) used to direct illumination (2406) for the purpose of augmenting the visual display attributes of the decorative display frame (2403). This technique may be useful in applications where it is desirable to reduce the backscatter illumination to the decorative frame. It will be apparent to one skilled in the art that an innumerable number of combinations of variations in lightbox configuration, light conduit means, and decorative frame construction are possible using the teachings of the present invention.

As stated previously and illustrated in FIG. 26 and FIG. 27, the decorative frame and the lightbox (2605, 2705) may in some cases be integrated into a single structure for cost savings and/or ease of assembly. In any case, the ability of the present invention to illuminate the decorative frame both promotes the aesthetic qualities of the decorative frame as well as providing a visual distraction to focus attention away from any illumination artifacts which may be present in the backlighting illumination of the display media. Thus, the present invention used the distractive nature of the decorative frame to permit a substantially appropriate uniform backlighting of the display media to be perceived by the viewer as a true uniform backlighting, even if this is not in fact the actual case.

Backscattering Variations

An important concept that is part of the teachings of the present invention is that there are a wide variety of variations associated with exactly how the light source illumination is backscattered to illuminate both the decorative frame and/or display media. FIG. 26 and FIG. 27 illustrate just two of these potential variations and will now be discussed.

FIG. 26 adds to the decorative frame an external front scattering member (2604) which accepts backscattered illumination from either the lightbox and/or the decorative frame and projects this onto the face of the display media (2601). Retaining clamp (2607) provides a means of fixing the scattering member to the media container and is exemplary of the many ways in which this functionality may be achieved. Note that this embodiment illustrates how illumination may be shared between the back of the display media, the decorative frame, and the front of the display media. This configuration is amenable to a wide variety of variations, each with their own aesthetic appeal and target application base.

FIG. 27 illustrates a variation of FIG. 26 in which the offset between the decorative frame and the media containment is reduced or eliminated. In this configuration, the external front scattering member (2704) is designed to provide the source of backscattered illumination for the decorative frame as well as the face of the display media. No doubt one skilled in the art can contrive other ways of redirecting the backscattered illumination from the light box to the front of the display media and decorative frame using these exemplary embodiments and the remaining teachings of the present invention.

Decorative Frame Illumination Variants

It must be stressed that the present invention has a wide range of variants in which the illumination to the decorative frame is varied via the use of selected frame construction materials and the like. A few exemplary embodiments of these variants will now be discussed.

Figure 25:
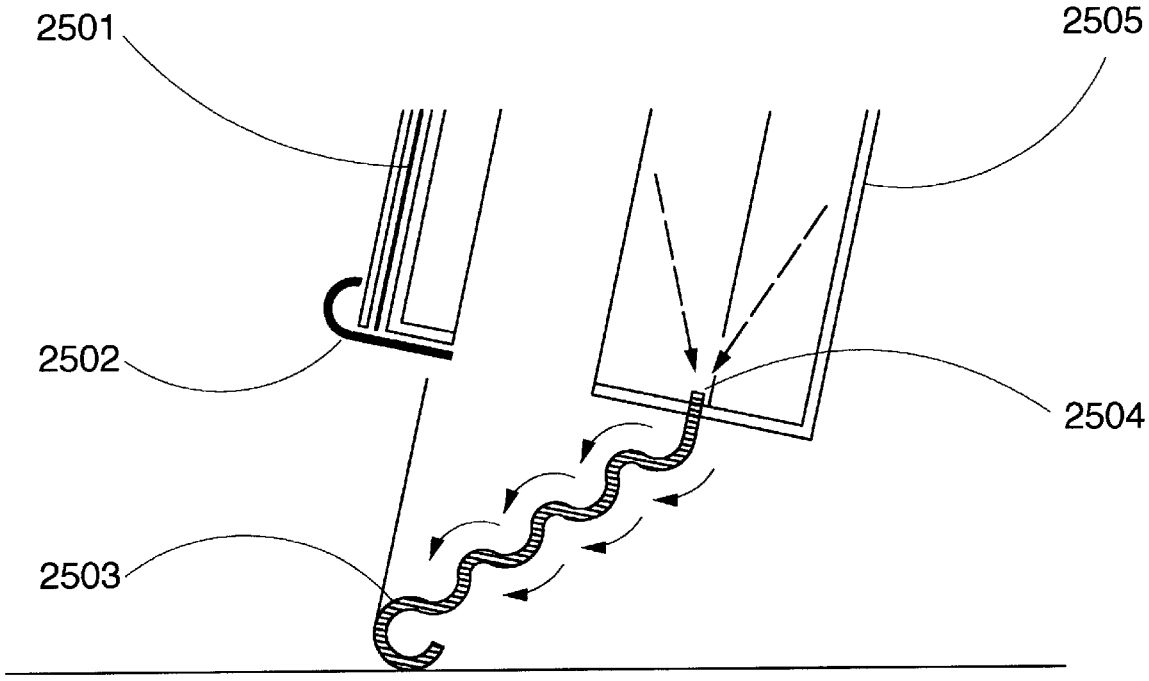
FIG. 25 illustrates a side view of an example of one exemplary embodiment of a preferred ornamental frame for use in embodiments of the present invention and the trans-induced (piped-light) light trajectories associated therewith.

FIG. 25 illustrates one potential variant of a decorative frame in which backscattered illumination is transmitted via a 'light pipe' arrangement (2504), thus illuminating the decorative frame (2503) from the inside, rather than illuminating the decorative frame from the outside as has been illustrated in other examples heretofore shown. This variant also indicates that the media container may also contain a retaining member (2502) which may also optionally be constructed of light piping material. Note that this approach to illumination may also be applied to situations in which an external reflective member is used to illuminate the display media, as may be the case in FIG. 26 (2604) and FIG. 27 (2704).

Figure 28:
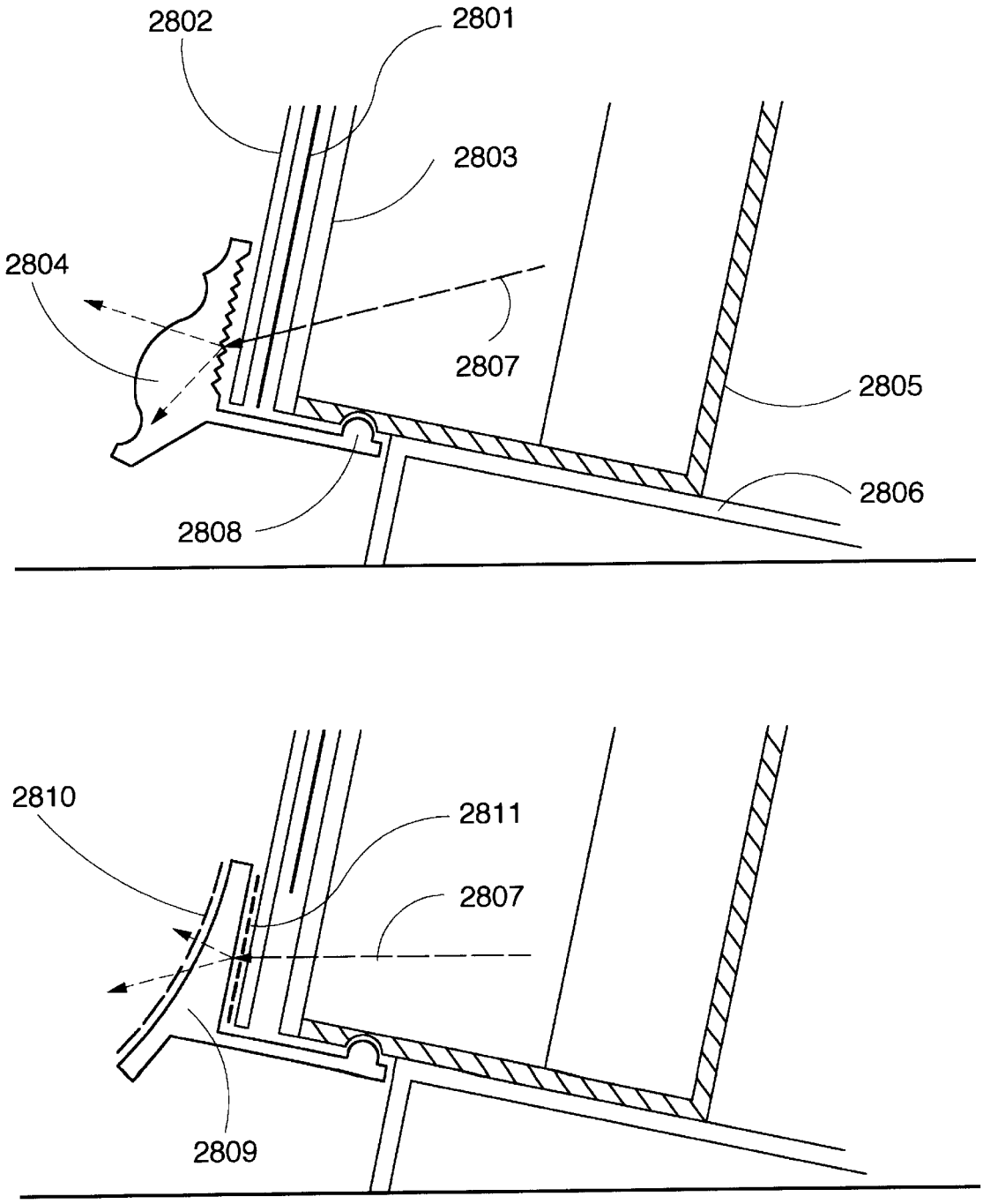
FIG. 28 illustrates two side views of several exemplary embodiments of the present invention in which the illumination of the decorative frame is modified by the use of a translucent and/or screen modifier.

This concept of using a transparent or translucent light-transmitting decorative frame has a wide variety of other applications, a few exemplary embodiments of which are illustrated in FIG. 28. Here the decorative frame (2804, 2809) may be incorporated within the context of the media container, and as such may be used to retain the display media (2801), the glazing (2802), and/or the media platen (2803). As with some other embodiments of the present invention, a retaining tong (2808) is included to secure the decorative frame to the lightbox and thus indirectly secure the display media, glazing, and/or media platen.

The present invention envisions that a decorative frame that is integrated with the retaining frame as in FIG. 28 may be constructed of translucent material which can modify the trajectory of backscatter illumination (2807) to achieve a wide range of visual effects. This translucent modifier (2804, 2809) may be further modified via the use of one or more screen modifiers (2810, 2811) which shield illumination and redirect the flow of illumination within the decorative frame translucent modifier. As illustrated in FIG. 28, these screen modifiers may work in conjunction with the display media itself to affect illumination shielding within the decorative frame. Thus, the display media itself may be used as a screening modifier in some embodiments, or may be cut back to allow other aspects of the decorative frame to serve this purpose. It is envisioned that a wide variety of materials may be used to construct the translucent modifier, but several preferred embodiments of the present invention use plastic or acrylic for this purpose.

It should be noted that while the exemplary embodiments of FIG. 28 may be more expensive to manufacture due to higher tooling costs, they do offer the advantage of permitting a wide variety of decorative frames to be mated to a standard lightbox chassis. This permits a standardization of the most expensive component of the backlighting system: the lightbox and media container. Thus, a wide variety of decorative frames may be constructed which mate with the standard lightbox enclosure and can therefore be changed to suit the tastes of the viewer. This may in some cases actually reduce the overall cost of the backlighting system in situations where a wide variety of decorative frames is a desirable feature.

Construction Materials

The present invention is amenable to construction using a wide variety of materials. The following discussion is designed to provide exemplary material choices, and should not be construed as limiting the types of construction materials to those provided in this description.

It is envisioned that many of the light transmitting elements of the present invention will be constructed of clear or translucent plastic, acrylic, glass, or the like, but a wide variety of other materials may be suitable for this purpose. With respect to the light reflecting elements of the present invention, it is envisioned that many of them will be constructed of white or other reflective materials. Specifically, the use of aluminized vacuum-formed plastics are envisioned for this application.

While most applications of the present invention will make use of a fluorescent light source, other lighting sources are possible and envisioned by this invention. Additionally, the majority of applications for this invention will desire the backlighting to be performed with white light, but there is nothing in the teachings of this invention to so limit the scope of the invention to white backlighting. Other colors are possible, and the light source may be optionally filtered within the lightbox to effect different backlighting colors. Similarly, the lightbox may be configured with filters to effect color changes to the illumination of the decorative frame as illustrated in FIG. 24.

The decorative frame is amenable to an infinite variety of forms, as its construction maps the availability of moldings and trim which are commercially available or which may be easily constructed by one skilled in the art. Typically, however, the decorative frame material will be wood, plastic, metal, ceramic, concrete, or some other commonly available material. Hybrid material constructions using a variety of materials are also possible.

OPERATION OF THE PRESENT INVENTION

Referencing the exemplary embodiment illustrated in FIG. 5, the display media is accessible from the viewer side by first removing the retainer frame. This is accomplished by typically using the forefinger and thumb of each hand to bend each flexible catch (510) outwards to disengage the platen receptors (511) enabling detachment of the retainer frame (505) and the protective glazing (506). As with the exemplary offsetting structure 'tongs' mentioned previously, it is envisioned that a similar wide variety of embodiments for the 'flexible catch' mechanism mentioned above will be possible for one skilled in the art to easily implement using the teachings of the present invention.

Maintaining the protective glazing in the retainer frame the display media (507) is inserted face first against the backside of the protective glazing while holding the display media assembly (502) components (505, 506, 507, 508) in combination, the assembly is aligned with the media platen (508) and slid as such to enable the retainer frame (505) to receive the media platen (508) within it's defined volume until the display media (507) has been uniformly combined with the protective glazing (506) and media platen (508). The retainer catches (510) engage the platen receptors (511) when the desired conditions of the combined materials is achieved. The operator then installs the backlighted display in an agreeable location and connects it to a source of electrical power.

It should be noted that the preferred embodiments of the present invention assume that the power source for the system is supplied by an external power cord (518). Since the present invention is designed to operate on surface tables and the like, it is envisioned that the invention could be embodied using battery power to supply the lighting source, thus permitting the elimination of external power cords and the like. One skilled in the art would have little difficulty in implementing such a battery powered model by incorporating a simple ON/OFF switch for the lighting source at a convenient location on the lightbox. Such a switch may also be implemented in situations where the invention embodiment is powered via an external power cord (518).

A useful addition to the discussion of switched electrical power above is the addition of an infrared, motion detection, or ambient light sensor to any of the invention embodiments to permit the lighting source to be automatically activated on the presence or detection of human activity in front of the display or on the detection of low light levels, etc. This addition permits a battery powered invention embodiment to be automatically activated when a human viewer is detected in front of the display, thus saving battery power during periods in which no human is viewing the display. Similar power savings apply to embodiments in which the system is powered with an external power source via a power cord (518). A significant application of this proposed embodiment could be in art galleries where the displays would be backlit on presence detection of the viewing public.

One skilled in the art of electronics will have little difficulty implementing a wide variety of ways to effect activation of this invention embodiment using ultrasonic detectors, infrared detectors, motion detectors, and/or ambient light detectors. The main point to be made in this context is that by making the backlit display responsive to the human viewer, an enhancement of the visual experience results. This concept can be further expanded to scenarios in which the illumination intensity is modulated by sound, movement, or other external activity to make the visual backlighting experience responsive to the human viewer.

PREFERRED SYSTEM CONTEXT OF THE PRESENT INVENTION

The numerous innovative teachings of the present application will be described with particular reference to the presently preferred embodiment, wherein these innovative teachings are advantageously applied to the particular problems of a SYSTEM AND METHOD OF BACKLIGHTING A DISPLAY. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The present invention has been designed to meet the cost, appearance, size, and ease-of-use requirements of a residential environment. However, meeting these goals also permits invention embodiments to have a wide range of commercial and artistic applications. Specifically, it is envisioned that the present invention may be embodied in a wide variety of commercial displays, both large and small, as well as have widespread application in the visual arts such as in art galleries and the like.

The ability of the present invention to be front-loaded and to be amenable to wall hanging with no external components other than an optional power cord makes this invention ideal for use in corporate sales environments or in environments where multiple numbers of backlit displays must be installed on a wall. Such an application might be a wall of photographs of individuals, company products, etc. The variations possible with the present invention are not limited to those just discussed, and one skilled in the visual and/or commercial arts will have little difficulty generating new applications for the present invention and the teachings thereof.

CONCLUSION

A system and method for backlighting a display medium have been presented which overcomes the nonuniform illumination drawbacks of the prior art while simultaneously providing an additional aesthetic feature not present in the prior art backlighting display systems. Furthermore, the present invention provides these features while permitting a substantial reduction in overall energy requirements by allowing a uniform backlighting system to be constructed with a single light source if desired. Other benefits, including reduced media degradation due to lower lightbox temperatures as well as permitting all lighting system components to be integrated into the lightbox for a more compact design result in a system which is desirable for use in both residential and industrial/exhibition environments. Finally, the modular nature of the present invention permits a wide variety of artistic and aesthetic effects to be implemented by simply rearranging and replacing system components, ensuring that as decorative tastes change the backlighting system can be correspondingly modified to reflect these requirements.

Although a preferred embodiment of the present invention has been illustrated in the accompanying Drawings and described in the foregoing Detailed Description, it will be understood that the invention is not limited to the embodiments disclosed, but is capable of numerous rearrangements, modifications, and substitutions without departing from the spirit of the invention as set forth and defined by the following claims.

What is claimed is:

1. A system for backlighting a display comprising:

(a) a display media container; and (b) a lightbox, said lightbox further comprising:

a light source at the periphery of said lightbox;

a light source mask;

a light source channel between said light source mask and said lightbox;

a light source backscattering device;

(c) a decorative frame surrounding said lightbox;

wherein said media container is positioned in front of said lightbox and in front of said decorative frame; and said light source illuminates both the backside of said display media container and said decorative frame.

2. A system for backlighting a display comprising:

(a) a display media container means; and (b) a lightbox means, said lightbox means further comprising:

a light source means at the periphery of said lightbox means;

a light source mask means;

a light source channel means between said light source mask means and said lightbox means;

a light source backscattering means;

(c) a decorative frame means surrounding said lightbox means;

wherein said media container means is positioned in front of said lightbox means and in front of said decorative frame means; and said light source means illuminates both the backside of said display media container means and said decorative frame means.

* * * * *